US010478364B2

(12) United States Patent
Fossez et al.

(10) Patent No.: US 10,478,364 B2
(45) Date of Patent: Nov. 19, 2019

(54) LIMB POSITIONING SYSTEM

(71) Applicant: Stryker Corporation, Kalamazoo, MI (US)

(72) Inventors: John R. Fossez, Frisco, TX (US); Paul Shiels, Albuquerque, NM (US)

(73) Assignee: Stryker Corporation, Kalamazoo, MI (US)

( * ) Notice: Subject to any disclaimer, the term of this patent is extended or adjusted under 35 U.S.C. 154(b) by 1008 days.

(21) Appl. No.: 14/642,038

(22) Filed: Mar. 9, 2015

(65) Prior Publication Data

US 2015/0250672 A1 Sep. 10, 2015

Related U.S. Application Data

(60) Provisional application No. 61/950,491, filed on Mar. 10, 2014.

(51) Int. Cl.
*A61G 13/10* (2006.01)
*A61G 13/12* (2006.01)

(52) U.S. Cl.
CPC ..... *A61G 13/1245* (2013.01); *A61G 13/101* (2013.01); *A61G 13/125* (2013.01); *A61G 13/1205* (2013.01); *A61G 13/129* (2013.01)

(58) Field of Classification Search
CPC ..... A61G 13/101; A61G 13/1205; A61G 13/1245; A61G 13/125; A61G 13/129;
(Continued)

(56) References Cited

U.S. PATENT DOCUMENTS 1,465,259 A 8/1923 Friedman
1,516,795 A 11/1924 Schwarting
(Continued)

FOREIGN PATENT DOCUMENTS

DE 202011000308 U1 4/2011
EP 2119400 A1 11/2009
(Continued)

OTHER PUBLICATIONS

European Search Report for EP Application 16161862.4 dated Sep. 26, 2016.
(Continued)

*Primary Examiner* — Kari K Rodriquez
*Assistant Examiner* — Camtu T Nguyen
(74) *Attorney, Agent, or Firm* — Lerner, David, Littenberg, Krumholz & Mentlik, LLP

(57) ABSTRACT

A limb positioning system includes a clamp assembly, a pylon and bar assembly, a sled assembly, and a limb positioning assembly. The clamp assembly is configured to attach to a bed rail of a surgical table and to accept a pylon connected to a bar. The pylon may have a plurality of pylon bars that are secured by the clamp assembly. A base bar may extend from the pylon, and may be attachable to an extension bar to provide a longer track along which the sled assembly may slide. The sled assembly may be biased to be locked with respect to the base bar. The limb holding assembly may include a boot coupled to the sled via a connector near the heel. The connector may be tapered and insertable into a correspondingly tapered section of a ball that sits within the sled assembly, the ball being capable of polyaxial motion.

5 Claims, 25 Drawing Sheets

(58) Field of Classification Search
CPC ..... A61G 13/123; A61G 13/1295; A61G 13/124; A61G 13/1235; A61G 15/12
See application file for complete search history.

(56) References Cited

U.S. PATENT DOCUMENTS 2,473,266 A 6/1949 Wexler
2,586,488 A 2/1952 Smith
2,998,476 A 8/1961 Nix
3,070,088 A 12/1962 Brahos
3,178,139 A 4/1965 McFarlin
3,221,743 A 12/1965 Thompson et al.
3,522,799 A 8/1970 Gauthier
3,542,015 A 11/1970 Steinman
3,544,060 A 12/1970 Stoltz et al.
3,632,152 A 1/1972 Renfroe
3,762,401 A 10/1973 Tupper
3,783,320 A 1/1974 Clement
3,823,709 A 7/1974 McGuire
3,998,217 A 12/1976 Trumbull et al.
4,018,412 A 4/1977 Kees, Jr. et al.
4,032,100 A 6/1977 Kahn
4,190,224 A 2/1980 LeBlanc et al.
4,232,681 A 11/1980 Tulaszewski
4,274,398 A 6/1981 Scott, Jr.
4,291,909 A 9/1981 Coatantiec
4,373,709 A 2/1983 Whitt
4,407,277 A 10/1983 Ellison
4,426,071 A 1/1984 Klevstad
4,428,571 A 1/1984 Sugarman
4,430,991 A 2/1984 Darnell
4,443,005 A 4/1984 Sugarman et al.
RE32,021 E 11/1985 Scott, Jr.
4,564,164 A 1/1986 Allen et al.
4,615,516 A 10/1986 Stulberg et al.
4,621,619 A 11/1986 Sharpe
4,717,102 A 1/1988 Pflieger
4,809,687 A 3/1989 Allen
4,813,401 A 3/1989 Grieshaber
4,846,431 A 7/1989 Pflieger
4,852,840 A 8/1989 Marks
4,865,019 A 9/1989 Phillips
4,901,963 A 2/1990 Yoder
4,901,964 A 2/1990 McConnell
4,953,820 A 9/1990 Yoder
4,997,154 A 3/1991 Little
5,001,739 A 3/1991 Fischer
5,007,912 A 4/1991 Albrektsson et al.
5,025,802 A 6/1991 Laico et al.
5,027,799 A 7/1991 Laico et al.
5,056,535 A 10/1991 Bonnell
5,224,680 A 7/1993 Greenstein et al.
5,231,974 A 8/1993 Giglio et al.
5,290,220 A 3/1994 Guhl
5,320,314 A 6/1994 Bookwalter et al.
5,320,444 A 6/1994 Bookwalter et al.
5,326,059 A 7/1994 Pryor et al.
5,351,680 A 10/1994 Jung
5,369,827 A 12/1994 Parke et al.
5,369,851 A 12/1994 Merkel
5,385,324 A 1/1995 Pryor et al.
5,462,551 A 10/1995 Bailey et al.
5,478,041 A 12/1995 Mayne
5,498,098 A 3/1996 Cairns
5,514,143 A 5/1996 Bonutti et al.
5,520,610 A 5/1996 Giglio et al.
5,535,973 A 7/1996 Bailey et al.
5,553,963 A 9/1996 Hoy et al.
5,560,577 A 10/1996 Keselman
5,581,900 A 12/1996 Payne
5,582,379 A 12/1996 Keselman et al.
5,645,079 A 7/1997 Zahiri et al.
5,662,300 A * 9/1997 Michelson ..... A61B 17/02 248/160
5,664,904 A 9/1997 Hapgood et al.
5,701,991 A 12/1997 Helmetsie
5,741,210 A 4/1998 Dobrovolny
5,769,783 A 6/1998 Fowler
5,775,334 A 7/1998 Lamb et al.
5,785,649 A 7/1998 Fowler, Jr.
5,799,349 A 9/1998 Petersen
5,800,346 A 9/1998 Adams
5,802,641 A 9/1998 Van Steenburg
5,810,721 A 9/1998 Mueller et al.
5,833,189 A 11/1998 Rossman et al.
5,836,559 A 11/1998 Ronci
5,846,192 A 12/1998 Teixido
5,853,156 A 12/1998 Moore et al.
5,876,333 A 3/1999 Bigliani et al.
5,899,853 A 5/1999 Fowler, Jr.
5,918,330 A 7/1999 Navarro et al.
5,938,592 A 8/1999 Koteles et al.
5,951,467 A 9/1999 Picha et al.
5,961,085 A 10/1999 Navarro et al.
5,964,697 A 10/1999 Fowler, Jr.
5,964,698 A 10/1999 Fowler
5,964,699 A 10/1999 Rullo et al.
5,976,080 A 11/1999 Farascioni
5,984,866 A 11/1999 Rullo et al.
6,015,128 A 1/2000 Lombardi
6,017,306 A 1/2000 Bigliani et al.
6,030,340 A 2/2000 Maffei et al.
6,048,309 A 4/2000 Flom et al.
6,058,534 A 5/2000 Navarro et al.
6,077,221 A 6/2000 Fowler, Jr.
6,090,042 A 7/2000 Rullo et al.
6,090,043 A 7/2000 Austin et al.
6,099,468 A 8/2000 Santilli et al.
6,102,853 A 8/2000 Scirica et al.
6,190,312 B1 2/2001 Fowler, Jr.
6,200,263 B1 3/2001 Person
6,213,940 B1 4/2001 Sherts et al.
6,228,026 B1 5/2001 Rullo et al.
6,234,173 B1 5/2001 Hajianpour
6,263,531 B1 7/2001 Navarro et al.
6,264,605 B1 7/2001 Scirica et al.
6,302,843 B1 10/2001 Lees et al.
6,315,718 B1 11/2001 Sharratt
6,340,345 B1 1/2002 Lees et al.
6,368,271 B1 4/2002 Sharratt
6,370,741 B1 4/2002 Lu
6,387,047 B1 5/2002 Duhaylongsod et al.
6,464,634 B1 10/2002 Fraser
6,468,207 B1 10/2002 Fowler, Jr.
6,471,171 B1 10/2002 VanderVelde
6,488,621 B1 12/2002 Rullo et al.
6,511,423 B2 1/2003 Farley
6,530,883 B2 3/2003 Bookwalter et al.
6,537,212 B2 3/2003 Sherts et al.
6,547,311 B1 4/2003 Derecktor
6,568,644 B2 5/2003 Pedersen
6,572,541 B1 6/2003 Petersvik
6,585,206 B2 7/2003 Metz et al.
6,598,275 B1 7/2003 Kolody et al.
6,610,009 B2 8/2003 Person
6,616,604 B1 9/2003 Bass et al.
6,616,605 B2 9/2003 Wright et al.
6,622,980 B2 9/2003 Boucher et al.
6,659,944 B2 12/2003 Sharratt
6,659,945 B2 12/2003 Ball et al.
6,663,055 B2 12/2003 Boucher et al.
6,704,959 B2 3/2004 Schuerch
6,733,445 B2 5/2004 Sherts et al.
6,736,775 B2 5/2004 Phillips
6,793,186 B2 9/2004 Pedersen
6,814,700 B1 11/2004 Mueller et al.
6,824,511 B1 11/2004 Bell et al.
6,826,794 B2 12/2004 Mahoney et al.
6,874,184 B2 4/2005 Chandler
6,875,172 B2 4/2005 Krebs
6,896,232 B2 5/2005 Crowell et al.
6,932,765 B2 8/2005 Berg
6,966,086 B2 11/2005 Metz et al.
7,003,827 B2 2/2006 DeMayo

(56) References Cited

U.S. PATENT DOCUMENTS

| | | | |
|---|---|---|---|
| 7,022,069 | B1 | 4/2006 | Masson et al. |
| 7,077,805 | B1 | 7/2006 | Masson et al. |
| 7,097,616 | B2 | 8/2006 | Bjork et al. |
| 7,125,380 | B2 | 10/2006 | Yager |
| 7,137,949 | B2 | 11/2006 | Scirica et al. |
| 7,156,806 | B2 | 1/2007 | Dobrovolny |
| 7,159,832 | B2 | 1/2007 | Easterling |
| 7,195,593 | B1 | 3/2007 | Masson et al. |
| 7,243,654 | B2 | 7/2007 | Schuerch |
| 7,246,390 | B2 | 7/2007 | Mitsuishi et al. |
| 7,264,589 | B2 | 9/2007 | Sharratt |
| 7,294,104 | B2 | 11/2007 | Person |
| 7,309,312 | B2 | 12/2007 | Bjork et al. |
| 7,316,040 | B2 | 1/2008 | Siccardi et al. |
| 7,337,483 | B2 | 3/2008 | Boucher et al. |
| 7,380,299 | B1 | 6/2008 | DeMayo |
| 7,386,922 | B1 | 6/2008 | Taylor et al. |
| 7,435,219 | B2 | 10/2008 | Kim |
| 7,458,933 | B2 | 12/2008 | LeVahn et al. |
| 7,520,007 | B2 | 4/2009 | Skripps |
| 7,566,038 | B2 | 7/2009 | Scott et al. |
| 7,624,958 | B2 | 12/2009 | Ropertz et al. |
| 7,665,167 | B2 | 2/2010 | Branch et al. |
| 7,686,267 | B2 | 3/2010 | DaSilva |
| 7,691,058 | B2 | 4/2010 | Rioux et al. |
| 7,725,162 | B2 | 5/2010 | Malackowski et al. |
| 7,731,141 | B2 | 6/2010 | Schuerch |
| 7,740,016 | B1 | 6/2010 | Pigg |
| 7,744,530 | B2 | 6/2010 | Person |
| RE41,412 | E | 7/2010 | Van Steenburg |
| 7,753,844 | B2 | 7/2010 | Sharratt et al. |
| 7,758,500 | B2 | 7/2010 | Boyd et al. |
| 7,775,974 | B2 | 8/2010 | Buckner et al. |
| 7,789,352 | B2 | 9/2010 | Darling, III |
| 7,811,230 | B2 | 10/2010 | Hsueh et al. |
| 7,827,992 | B2 | 11/2010 | Sieber |
| 7,832,035 | B2 | 11/2010 | Walczyk |
| 7,832,401 | B2 | 11/2010 | Torrie et al. |
| 7,909,761 | B2 | 3/2011 | Banchieri et al. |
| 7,931,591 | B2 | 4/2011 | McCarthy et al. |
| 7,947,006 | B2 | 5/2011 | Torrie et al. |
| 7,947,862 | B2 | 5/2011 | Livorsi |
| 7,951,097 | B2 | 5/2011 | Schaeffer |
| 7,955,257 | B2 | 6/2011 | Frasier et al. |
| 7,985,227 | B2 | 7/2011 | Branch et al. |
| 8,001,633 | B2 | 8/2011 | Swain, Jr. |
| 8,011,629 | B2 | 9/2011 | Herskovic |
| 8,020,559 | B2 | 9/2011 | Lacriox |
| 8,038,106 | B2 | 10/2011 | Magno, Jr. et al. |
| 8,038,611 | B2 | 10/2011 | Raymond et al. |
| 8,051,515 | B1 | 11/2011 | Kring |
| 8,066,239 | B2 | 11/2011 | Molnar et al. |
| 8,070,119 | B2 | 12/2011 | Taylor |
| 8,085,481 | B2 | 12/2011 | Hill |
| 8,099,808 | B1 | 1/2012 | McKeon |
| 8,100,827 | B2 | 1/2012 | Farley |
| 8,114,018 | B2 | 2/2012 | Park et al. |
| 8,117,695 | B2 | 2/2012 | Paz et al. |
| 8,132,278 | B1 | 3/2012 | Bailey |
| 8,141,839 | B2 | 3/2012 | Buchner |
| 8,146,599 | B2 | 4/2012 | Wilson et al. |
| 8,146,963 | B2 | 4/2012 | Wyslucha |
| 8,167,259 | B2 | 5/2012 | Spang, Jr. et al. |
| 8,182,469 | B2 | 5/2012 | Anderson et al. |
| 8,226,590 | B2 | 7/2012 | Tucker et al. |
| 8,230,864 | B2 | 7/2012 | Hunter, Jr. |
| 8,231,528 | B1 | 7/2012 | Friedrich et al. |
| 8,231,529 | B2 | 7/2012 | Kanekasu et al. |
| 8,239,988 | B2 | 8/2012 | Brenner |
| 8,246,028 | B2 | 8/2012 | Larkin et al. |
| 8,262,567 | B2 | 9/2012 | Sharp et al. |
| 8,286,283 | B2 | 10/2012 | Copeland et al. |
| 8,302,228 | B2 | 11/2012 | Aboujaoude |
| 8,302,921 | B2 | 11/2012 | Schuerch |
| 8,317,710 | B2 | 11/2012 | Nakamura et al. |
| 8,322,342 | B2 | 12/2012 | Soto et al. |
| 8,332,977 | B2 | 12/2012 | Bochner et al. |
| 8,356,601 | B2 | 1/2013 | Hunter, Jr. |
| 8,388,528 | B2 | 3/2013 | Rioux et al. |
| 8,393,588 | B2 | 3/2013 | Blum et al. |
| 8,413,660 | B2 | 4/2013 | Weinstein et al. |
| 8,448,274 | B2 | 5/2013 | Broens |
| 8,459,602 | B2 | 6/2013 | Herskovic |
| 8,469,033 | B2 | 6/2013 | Gardner et al. |
| 8,469,911 | B2 | 6/2013 | Hiebert |
| 8,474,076 | B2 | 7/2013 | Hornbach |
| 8,485,484 | B2 | 7/2013 | Kronner et al. |
| 8,485,952 | B2 | 7/2013 | Gehrke |
| 8,523,769 | B2 | 9/2013 | Fehling et al. |
| 8,523,770 | B2 | 9/2013 | McLoughlin |
| 8,544,127 | B2 | 10/2013 | Hsieh |
| 8,561,234 | B1 | 10/2013 | Kring |
| 8,566,984 | B2 | 10/2013 | Paz et al. |
| 8,579,244 | B2 | 11/2013 | Bally |
| 8,617,064 | B2 | 12/2013 | Farley |
| 8,621,692 | B1 | 1/2014 | Kring |
| 8,636,680 | B2 | 1/2014 | Hiebert |
| 8,636,744 | B2 | 1/2014 | Tochigi et al. |
| 8,657,767 | B2 | 2/2014 | Chan |
| 8,690,807 | B2 | 4/2014 | Hiebert |
| 8,695,135 | B2 | 4/2014 | Berube |
| 8,695,137 | B1 | 4/2014 | Hanson |
| 8,696,558 | B1 | 4/2014 | Parker et al. |
| 8,696,559 | B2 | 4/2014 | Miles et al. |
| 8,696,560 | B2 | 4/2014 | Strauss et al. |
| 8,696,562 | B2 | 4/2014 | Mulac et al. |
| 8,696,607 | B2 | 4/2014 | McDonnell et al. |
| 8,701,674 | B2 | 4/2014 | Tweardy et al. |
| 8,702,054 | B2 | 4/2014 | Lindner et al. |
| 8,702,600 | B2 | 4/2014 | Perrow |
| 8,706,189 | B2 | 4/2014 | Hagen et al. |
| 8,707,486 | B2 | 4/2014 | Chella et al. |
| 8,707,487 | B2 | 4/2014 | Kullman |
| 8,713,728 | B2 | 5/2014 | Heimbrock et al. |
| 8,713,733 | B2 | 5/2014 | Caforio |
| 8,714,502 | B1 | 5/2014 | Davis |
| 8,714,503 | B1 | 5/2014 | Fadrow |
| 8,714,567 | B2 | 5/2014 | Fievet |
| 8,715,174 | B2 | 5/2014 | Kaul |
| 8,719,983 | B2 | 5/2014 | Nash |
| 8,720,447 | B2 | 5/2014 | North |
| 8,720,724 | B1 | 5/2014 | Lynn, IV |
| 8,721,537 | B2 | 5/2014 | Albrecht et al. |
| 8,721,538 | B2 | 5/2014 | Bucholz |
| 8,721,539 | B2 | 5/2014 | Shohat et al. |
| 8,721,577 | B1 | 5/2014 | Perry |
| 8,724,884 | B2 | 5/2014 | Lomas et al. |
| 8,726,435 | B2 | 5/2014 | Briody |
| 8,727,291 | B2 | 5/2014 | Scoggins et al. |
| 8,727,972 | B2 | 5/2014 | Zhang et al. |
| 8,727,973 | B2 | 5/2014 | Okoniewski |
| 8,727,975 | B1 | 5/2014 | Pfabe et al. |
| 8,728,019 | B2 | 5/2014 | Kruijsen et al. |
| 8,732,875 | B2 | 5/2014 | O'Keefe |
| 8,733,027 | B1 | 5/2014 | Marston et al. |
| 8,733,362 | B2 | 5/2014 | Krook et al. |
| 8,733,365 | B2 | 5/2014 | Krenzel |
| 8,734,338 | B2 | 5/2014 | Gorek et al. |
| 8,734,371 | B2 | 5/2014 | Robertson |
| 8,739,335 | B1 | 6/2014 | Hoggatt |
| 8,739,337 | B1 | 6/2014 | Sanders et al. |
| 8,740,162 | B1 | 6/2014 | Morgan |
| 8,740,786 | B2 | 6/2014 | Blain et al. |
| 8,740,787 | B2 | 6/2014 | Santilli |
| 8,745,787 | B1 | 6/2014 | Heimlich |
| 8,746,497 | B2 | 6/2014 | Bourbeau et al. |
| 8,747,302 | B2 | 6/2014 | Piskun |
| 8,747,307 | B2 | 6/2014 | Miles et al. |
| 8,747,309 | B2 | 6/2014 | Viola |
| 8,753,266 | B2 | 6/2014 | Spence et al. |
| 8,753,269 | B2 | 6/2014 | Tabor |
| 8,753,270 | B2 | 6/2014 | Miles et al. |
| 8,753,272 | B2 | 6/2014 | Farley |
| 8,753,298 | B2 | 6/2014 | Sebelius et al. |

(56) References Cited

U.S. PATENT DOCUMENTS

| | | | |
|---|---|---|---|
| 8,753,358 | B2 | 6/2014 | Cook |
| 8,756,735 | B2 | 6/2014 | Heimbrock et al. |
| 8,757,573 | B1 | 6/2014 | Barnes, Jr. |
| 8,758,235 | B2 | 6/2014 | Jaworek |
| 8,758,236 | B2 | 6/2014 | Albrecht et al. |
| 8,763,177 | B2 | 7/2014 | Shah et al. |
| 8,764,649 | B2 | 7/2014 | Miles et al. |
| 8,764,692 | B2 | 7/2014 | Ferrigolo et al. |
| 8,769,781 | B2 | 7/2014 | Carney |
| 8,770,200 | B2 | 7/2014 | Ahluwalia |
| 8,771,179 | B2 | 7/2014 | Lozman et al. |
| 8,771,210 | B2 | 7/2014 | Smith et al. |
| 8,771,213 | B2 | 7/2014 | Wens |
| 8,776,294 | B1 | 7/2014 | McCarty et al. |
| 8,776,798 | B2 | 7/2014 | Choi et al. |
| 8,777,169 | B2 | 7/2014 | Raye et al. |
| 8,777,171 | B2 | 7/2014 | Gainey, Jr. et al. |
| 8,777,849 | B2 | 7/2014 | Haig et al. |
| 8,777,882 | B2 | 7/2014 | Ho |
| 8,782,832 | B2 | 7/2014 | Blyakher et al. |
| 8,783,264 | B2 | 7/2014 | Levendowski et al. |
| 8,783,416 | B2 | 7/2014 | Singleton et al. |
| 8,783,636 | B2 | 7/2014 | Okita |
| 8,784,305 | B2 | 7/2014 | DeSantis et al. |
| 8,784,306 | B2 | 7/2014 | Roth et al. |
| 8,789,533 | B2 | 7/2014 | Steffens et al. |
| 8,790,245 | B2 | 7/2014 | Rodriguez Fernandez et al. |
| 8,794,241 | B2 | 8/2014 | Dal Monte |
| 8,795,163 | B2 | 8/2014 | Widenhouse et al. |
| 8,795,164 | B2 | 8/2014 | Stopek |
| 8,795,213 | B2 | 8/2014 | Mills |
| 8,795,289 | B2 | 8/2014 | Fowler et al. |
| 8,795,326 | B2 | 8/2014 | Richard |
| 8,800,569 | B2 | 8/2014 | Whitmore, III et al. |
| 8,800,921 | B2 | 8/2014 | Gensch et al. |
| 8,800,941 | B2 | 8/2014 | Kahn |
| 8,801,349 | B2 | 8/2014 | McPheeters |
| 8,801,608 | B2 | 8/2014 | Hardenbrook |
| 8,801,730 | B2 | 8/2014 | Jacob |
| 8,804,321 | B2 | 8/2014 | Kincaid et al. |
| 8,806,683 | B2 | 8/2014 | Gauta |
| 8,807,353 | B2 | 8/2014 | Barkdoll et al. |
| 8,808,172 | B2 | 8/2014 | Manzanares |
| 8,808,173 | B2 | 8/2014 | Okazaki et al. |
| 8,808,174 | B2 | 8/2014 | Kleyman |
| 8,808,175 | B2 | 8/2014 | Deitch et al. |
| 8,808,176 | B2 | 8/2014 | Menendez et al. |
| 8,808,212 | B1 | 8/2014 | Redmond |
| 8,808,215 | B2 | 8/2014 | Gaylord |
| 8,814,107 | B2 | 8/2014 | Hampe et al. |
| 8,814,118 | B2 | 8/2014 | Okita et al. |
| 8,814,213 | B2 | 8/2014 | Aosima et al. |
| 8,814,788 | B2 | 8/2014 | Gan |
| 8,820,548 | B2 | 9/2014 | Wilson |
| 8,820,686 | B2 | 9/2014 | Hickle et al. |
| 8,820,690 | B2 | 9/2014 | Weber |
| 8,821,044 | B1 | 9/2014 | Dordick |
| 8,821,390 | B2 | 9/2014 | Kleyman |
| 8,821,393 | B2 | 9/2014 | Taylor et al. |
| 8,821,394 | B2 | 9/2014 | Hawkins et al. |
| 8,821,423 | B2 | 9/2014 | Conlon et al. |
| 8,826,704 | B1 | 9/2014 | Marshall |
| 8,827,037 | B2 | 9/2014 | Chilton |
| 8,827,216 | B2 | 9/2014 | Brown et al. |
| 8,827,223 | B2 | 9/2014 | Miller |
| 8,827,902 | B2 | 9/2014 | Dietze, Jr. et al. |
| 8,827,903 | B2 | 9/2014 | Shelton, IV et al. |
| 8,830,070 | B2 | 9/2014 | Dixon et al. |
| 8,832,878 | B2 | 9/2014 | McGann |
| 8,833,118 | B1 | 9/2014 | McLane |
| 8,833,707 | B2 | 9/2014 | Steinberg et al. |
| 8,834,361 | B2 | 9/2014 | Hashiba et al. |
| 8,834,362 | B2 | 9/2014 | Shipp |
| 8,834,394 | B2 | 9/2014 | Ghajar |
| 8,834,396 | B2 | 9/2014 | Gainey |
| 8,839,501 | B2 | 9/2014 | McClain et al. |
| 8,839,794 | B2 | 9/2014 | Tonks et al. |
| 8,839,797 | B1 | 9/2014 | DeMayo |
| 8,840,075 | B2 | 9/2014 | Dalebout et al. |
| 8,840,076 | B2 | 9/2014 | Zuber et al. |
| 8,840,547 | B2 | 9/2014 | Rivera et al. |
| 8,844,074 | B2 | 9/2014 | Mohr et al. |
| 8,844,210 | B2 | 9/2014 | Henriott |
| 8,844,536 | B1 | 9/2014 | Schuele |
| 8,844,885 | B1 | 9/2014 | Reece-Sullivan |
| 8,845,517 | B2 | 9/2014 | Russo |
| 8,845,520 | B2 | 9/2014 | Belfiore et al. |
| 8,845,527 | B2 | 9/2014 | Crenshaw et al. |
| 8,845,528 | B2 | 9/2014 | Kleyman |
| 8,845,568 | B2 | 9/2014 | Clark et al. |
| 8,847,756 | B2 | 9/2014 | Tallent et al. |
| 8,848,378 | B2 | 9/2014 | Liao |
| 8,850,648 | B2 | 10/2014 | D'Andrea |
| 8,851,196 | B2 | 10/2014 | Silcox et al. |
| 8,852,089 | B2 | 10/2014 | Blackwell et al. |
| 8,852,090 | B2 | 10/2014 | Friedrich et al. |
| 8,852,253 | B2 | 10/2014 | Mafi |
| 8,856,985 | B2 | 10/2014 | Rensink et al. |
| 8,856,988 | B2 | 10/2014 | Frazier |
| 8,857,441 | B2 | 10/2014 | Matsuo et al. |
| 8,857,771 | B2 | 10/2014 | Streetman |
| 8,857,775 | B1 | 10/2014 | Clearman et al. |
| 8,858,193 | B2 | 10/2014 | Wu |
| 8,858,482 | B2 | 10/2014 | Ingimundarson et al. |
| 8,858,538 | B2 | 10/2014 | Belson et al. |
| 8,863,333 | B2 | 10/2014 | Cain et al. |
| 8,863,334 | B2 | 10/2014 | Gibbons et al. |
| 8,864,091 | B1 | 10/2014 | Patriarco |
| 8,864,104 | B2 | 10/2014 | Koch et al. |
| 8,864,658 | B2 | 10/2014 | Wilkins et al. |
| 8,864,659 | B2 | 10/2014 | Davis |
| 8,864,661 | B2 | 10/2014 | Olsen |
| 8,864,662 | B2 | 10/2014 | Grey et al. |
| 8,864,697 | B1 | 10/2014 | Baker et al. |
| 8,866,610 | B2 | 10/2014 | Riley et al. |
| 8,869,355 | B2 | 10/2014 | Huang |
| 8,869,801 | B1 | 10/2014 | Thompson |
| 8,870,044 | B1 | 10/2014 | Freese et al. |
| 8,870,136 | B2 | 10/2014 | Ellingboe et al. |
| 8,870,727 | B2 | 10/2014 | Palmer |
| 8,870,759 | B2 | 10/2014 | Viola et al. |
| 8,870,760 | B2 | 10/2014 | Heiges et al. |
| 8,870,799 | B2 | 10/2014 | Reiley |
| 8,870,802 | B1 | 10/2014 | Anderson et al. |
| 8,870,803 | B2 | 10/2014 | Reiley et al. |
| 8,870,900 | B2 | 10/2014 | Julian et al. |
| 8,875,327 | B2 | 11/2014 | Gilley et al. |
| 8,875,329 | B2 * | 11/2014 | Gomez ..... A61G 13/1235 128/845 |
| 8,875,743 | B2 | 11/2014 | Persaud et al. |
| 8,876,710 | B2 | 11/2014 | Ferreira |
| 8,876,712 | B2 | 11/2014 | Yee et al. |
| 8,879,361 | B2 | 11/2014 | McGee |
| 8,881,732 | B2 | 11/2014 | Blurton et al. |
| 8,882,056 | B2 | 11/2014 | Greenfield |
| 8,882,066 | B2 | 11/2014 | Otten et al. |
| 8,882,661 | B2 | 11/2014 | Hutton et al. |
| 8,882,662 | B2 | 11/2014 | Charles |
| 8,882,688 | B1 | 11/2014 | Ancinec |
| 8,882,690 | B2 | 11/2014 | Toenges |
| 8,887,329 | B2 | 11/2014 | Soltani |
| 8,887,336 | B2 | 11/2014 | Pezzani et al. |
| 8,887,732 | B2 | 11/2014 | Choi et al. |
| 8,888,694 | B2 | 11/2014 | Calvosa et al. |
| 8,888,695 | B2 | 11/2014 | Piskun et al. |
| 8,893,333 | B2 | 11/2014 | Soto et al. |
| 8,893,335 | B1 | 11/2014 | Hijuelos |
| 8,894,028 | B2 | 11/2014 | Golden et al. |
| 8,894,029 | B2 | 11/2014 | Agbodoe et al. |
| 8,894,571 | B2 | 11/2014 | Albrecht et al. |
| 8,894,572 | B2 | 11/2014 | Bastia et al. |
| 8,894,574 | B2 | 11/2014 | Ellman |
| 8,894,575 | B2 | 11/2014 | Stopek |
| 8,894,598 | B2 | 11/2014 | Ponsi et al. |

(56) References Cited

U.S. PATENT DOCUMENTS 8,894,659 B2 11/2014 Stauber
8,896,993 B2 11/2014 Belesiu et al.
8,898,836 B1 12/2014 Puri et al.
8,899,539 B2 12/2014 Oliver et al.
8,900,137 B1 12/2014 Lovell et al.
8,905,035 B2 12/2014 Wilson et al.
8,905,451 B1 12/2014 Golz
8,905,923 B2 12/2014 Carlson
8,905,950 B2 12/2014 Bonutti et al.
8,910,333 B2 12/2014 Wu
8,910,636 B2 12/2014 Kakko
8,911,364 B2 12/2014 Feigenwinter et al.
8,914,925 B2 12/2014 Angott
8,915,478 B2 12/2014 Perez
8,915,845 B2 12/2014 Pell et al.
8,915,846 B2 12/2014 Miles et al.
8,915,847 B1 12/2014 Wang
8,915,848 B1 12/2014 Rixen
8,915,947 B2 12/2014 Robinson
8,918,931 B1 12/2014 Baker et al.
8,919,346 B2 12/2014 Carlin
8,919,709 B2 12/2014 Zhou et al.
8,919,714 B2 12/2014 Rizk et al.
8,920,314 B2 12/2014 Kleyman et al.
8,920,315 B2 12/2014 Schulte
8,920,354 B2 12/2014 Liberson
8,920,467 B2 12/2014 Taguchi et al.
8,925,179 B2 1/2015 Kirsch et al.
8,925,263 B2 1/2015 Haddock et al.
8,926,505 B2 1/2015 Wenchell
8,931,747 B2 1/2015 Davis
8,931,973 B2 1/2015 Olszewski
8,932,210 B2 1/2015 Woods
8,932,213 B2 1/2015 Okoniewski
8,932,214 B2 1/2015 Hart et al.
8,932,215 B2 1/2015 Friedrich et al.
8,932,242 B2 1/2015 Rohde et al.
9,022,334 B1 5/2015 DeMayo
9,615,987 B2 4/2017 Worm et al.
2002/0128577 A1 9/2002 Smart
2003/0080267 A1 5/2003 Eslick
2003/0083553 A1 5/2003 Berg
2003/0154550 A1 8/2003 Murphy et al.
2004/0059194 A1 3/2004 Berg et al.
2004/0186356 A1 9/2004 O'Malley et al.
2004/0242969 A1 12/2004 Sherts et al.
2005/0119531 A1 6/2005 Sharratt
2005/0119697 A1 6/2005 Sharratt
2005/0171405 A1 8/2005 Rowland et al.
2005/0215865 A1 9/2005 LeVahn et al.
2005/0278851 A1 12/2005 DeMayo
2006/0038098 A1 2/2006 Metz et al.
2006/0135852 A1 6/2006 Koros et al.
2007/0251011 A1 11/2007 Matta et al.
2009/0012370 A1 1/2009 Gutierrez et al.
2009/0235457 A1 9/2009 Harvey
2009/0264709 A1 10/2009 Blurton et al.
2009/0264710 A1 10/2009 Chana et al.
2009/0287060 A1 11/2009 Pell et al.
2009/0306466 A1 12/2009 Bonadio et al.
2010/0071704 A1 3/2010 Domondon
2010/0081880 A1 4/2010 Widenhouse et al.
2010/0108841 A1 5/2010 Kronner et al.
2010/0133400 A1 6/2010 Scott et al.
2010/0145155 A1 6/2010 Sorajja
2010/0163055 A1 7/2010 Wilkinson
2010/0185060 A1 7/2010 Farley
2010/0192961 A1 8/2010 Amiot et al.
2010/0230567 A1 9/2010 Schuerch
2010/0242181 A1 9/2010 Bochner et al.
2010/0252702 A1 10/2010 Spang, Jr. et al.
2010/0286481 A1 11/2010 Sharp et al.
2010/0292540 A1 11/2010 Hess et al.
2010/0317927 A1 12/2010 Rumsey
2011/0009706 A1 1/2011 Abdelgany et al.
2011/0023893 A1 2/2011 Striggow et al.
2011/0030698 A1 2/2011 Kaufman et al.
2011/0054259 A1 3/2011 Gorek et al.
2011/0112455 A1 5/2011 Rocklin
2011/0137130 A1 6/2011 Thalgott et al.
2011/0201897 A1 8/2011 Bertagnoli et al.
2011/0213207 A1 9/2011 Frasier et al.
2011/0295075 A1 12/2011 Picha et al.
2012/0085353 A1 4/2012 Siston et al.
2012/0136215 A1 5/2012 Farley
2012/0157788 A1 6/2012 Serowski et al.
2012/0204885 A1 8/2012 Koch
2012/0216348 A1 8/2012 Cox
2012/0232350 A1 9/2012 Seex
2012/0232353 A1 9/2012 McLoughlin
2012/0233782 A1* 9/2012 Kreuzer ..... A61G 13/125 5/624
2012/0238828 A1 9/2012 Fricke
2012/0240938 A1 9/2012 Pamichev
2012/0241571 A1 9/2012 Masionis et al.
2012/0259261 A1 10/2012 Clark et al.
2012/0316400 A1 12/2012 Vijayanagar
2012/0318278 A1 12/2012 Aboujaoude et al.
2012/0324650 A1 12/2012 Russell
2013/0019883 A1* 1/2013 Worm ..... A61G 13/101 128/882
2013/0030254 A1 1/2013 Thalgott et al.
2013/0032156 A1 2/2013 Kring
2013/0087154 A1 4/2013 Hoffman et al.
2013/0137934 A1 5/2013 Slaga et al.
2013/0191994 A1 8/2013 Bellows et al.
2013/0191995 A1 8/2013 Bellows et al.
2013/0192608 A1 8/2013 Hiebert
2013/0192609 A1 8/2013 Bellows et al.
2013/0204091 A1 8/2013 Menendez et al.
2013/0206148 A1 8/2013 Hiebert
2013/0206149 A1 8/2013 Spendley
2013/0219625 A1 8/2013 Hsieh
2013/0245383 A1 9/2013 Friedrich et al.
2013/0245384 A1 9/2013 Friedrich et al.
2013/0247919 A1 9/2013 Chauvette et al.
2013/0263863 A1 10/2013 Baker et al.
2013/0269109 A1 10/2013 Yu
2013/0303859 A1 11/2013 Nowak et al.
2013/0318721 A1 12/2013 Gauta
2013/0326818 A1 12/2013 Wood et al.
2014/0005485 A1 1/2014 Tesar et al.
2014/0007408 A1 1/2014 Nool
2014/0039267 A1 2/2014 Seex et al.
2014/0058210 A1 2/2014 Raymond et al.
2014/0059773 A1 3/2014 Carn
2014/0096777 A1 4/2014 Derner
2014/0096779 A1 4/2014 Roggenkamp
2014/0100430 A1 4/2014 Beane et al.
2014/0101851 A1 4/2014 Schuerch, Jr.
2014/0107425 A1 4/2014 Bonadio et al.
2014/0107426 A1 4/2014 Wilson
2014/0110545 A1 4/2014 Goett
2014/0114134 A1 4/2014 Theofilos et al.
2014/0114135 A1 4/2014 Ellman
2014/0114136 A1 4/2014 Ellman
2014/0114137 A1 4/2014 Reglos et al.
2014/0114138 A1 4/2014 Fedorov et al.
2014/0114139 A1 4/2014 Ziolo et al.
2014/0115789 A1 5/2014 Ramdath
2014/0116452 A1 5/2014 Ingimundarson et al.
2014/0117197 A1 5/2014 Stover et al.
2014/0121467 A1 5/2014 Vayser et al.
2014/0123984 A1 5/2014 Johnson et al.
2014/0128682 A1 5/2014 Loebl et al.
2014/0128683 A1 5/2014 Puskas et al.
2014/0128684 A1 5/2014 Carlson
2014/0130260 A1 5/2014 Kreuzer et al.
2014/0135586 A1 5/2014 Brustad et al.
2014/0137874 A1 5/2014 O'Reagan
2014/0138503 A1 5/2014 Consaul
2014/0138505 A1 5/2014 Maclaren-Taylor
2014/0142393 A1 5/2014 Piskun et al.
2014/0144450 A1 5/2014 Aarestad et al.

(56) References Cited

U.S. PATENT DOCUMENTS

2014/0144451 A1 5/2014 Thanas
2014/0148649 A1 5/2014 Miles et al.
2014/0148654 A1 5/2014 Abrahams
2014/0150803 A1 6/2014 Gold
2014/0158139 A1 6/2014 Sayegh
2014/0158140 A1 6/2014 Sklar
2014/0163318 A1 6/2014 Swanstrom
2014/0163327 A1 6/2014 Swanstrom
2014/0165291 A1 6/2014 McCarty et al.
2014/0166022 A1 6/2014 Brown
2014/0171748 A1 6/2014 Bookwalter et al.
2014/0173827 A1 6/2014 Hiebert
2014/0174451 A1 6/2014 Hiebert
2014/0174452 A1 6/2014 Reaves
2014/0174453 A1 6/2014 Panzica
2014/0174454 A1 6/2014 Naef
2014/0179998 A1 6/2014 Pacey et al.
2014/0180013 A1 6/2014 Hanlon et al.
2014/0180016 A1 6/2014 Miles et al.
2014/0180017 A1 6/2014 Mulac et al.
2014/0180036 A1 6/2014 Bukkapatnam et al.
2014/0182049 A1 7/2014 Prust et al.
2014/0182603 A1 7/2014 Coppens
2014/0183313 A1 7/2014 McClain et al.
2014/0187869 A1 7/2014 Fan
2014/0190488 A1 7/2014 Robran et al.
2014/0191097 A1 7/2014 Noah et al.
2014/0194698 A1 7/2014 Melsheimer et al.
2014/0197289 A1 7/2014 Chen
2014/0197290 A1 7/2014 Davis
2014/0202468 A1 7/2014 Parsi
2014/0213853 A1 7/2014 Strauss et al.
2014/0215716 A1 8/2014 Mohr et al.
2014/0216468 A1 8/2014 Goldshleger et al.
2014/0221759 A1 8/2014 Mackool et al.
2014/0221761 A1 8/2014 Im
2014/0221762 A1 8/2014 Rebuffat et al.
2014/0221764 A1 8/2014 Pittenger et al.
2014/0228719 A1 8/2014 Richards et al.
2014/0230827 A1 8/2014 Jobe et al.
2014/0231605 A1 8/2014 Sharpe et al.
2014/0235949 A1 8/2014 Smith
2014/0235953 A1 8/2014 Okoniewski
2014/0237720 A1 8/2014 Heimbrock et al.
2014/0238408 A1 8/2014 Shepherd
2014/0238409 A1 8/2014 O'Brien
2014/0243599 A1 8/2014 Farin et al.
2014/0245536 A1 9/2014 Ermalovich
2014/0249375 A1 9/2014 Rodrigues, Jr.
2014/0249531 A1 9/2014 Staunton
2014/0251341 A1 9/2014 Simonian
2014/0252291 A1 9/2014 Koering
2014/0257035 A1 9/2014 Blain
2014/0257038 A1 9/2014 Kleyman
2014/0257040 A1 9/2014 Albrecht et al.
2014/0257041 A1 9/2014 Lloyd
2014/0259425 A1 9/2014 Lovechio
2014/0261447 A1 9/2014 Giles
2014/0261448 A1 9/2014 Knight
2014/0263904 A1 9/2014 Kozyra
2014/0268512 A1 9/2014 Kho et al.
2014/0275697 A1 9/2014 Filiberti
2014/0275751 A1 9/2014 Heitel et al.
2014/0275791 A1 9/2014 Lambrecht et al.
2014/0275799 A1 9/2014 Schuele
2014/0275801 A1 9/2014 Menchaca et al.
2014/0275802 A1 9/2014 Gerdts et al.
2014/0276022 A1 9/2014 Oghalai et al.
2014/0276068 A1 9/2014 Szpak et al.
2014/0283305 A1 9/2014 Zysman
2014/0283845 A1 9/2014 Slusarz, Jr.
2014/0283846 A1 9/2014 Fallouh
2014/0283849 A1 9/2014 Pecina et al.
2014/0284441 A1 9/2014 Easterbrook
2014/0288377 A1 9/2014 Worrel
2014/0288379 A1 9/2014 Miles et al.
2014/0290666 A1 10/2014 Agee et al.
2014/0290667 A1 10/2014 Masui
2014/0291461 A1 10/2014 Womble
2014/0296646 A1 10/2014 Wingeier et al.
2014/0296650 A1 10/2014 Weisshaupt et al.
2014/0296747 A1 10/2014 Herrnsdorf
2014/0303447 A1 10/2014 Singh et al.
2014/0303477 A1 10/2014 Sunazuka et al.
2014/0304914 A1 10/2014 Schnake et al.
2014/0304919 A1 10/2014 Hochman et al.
2014/0305441 A1 10/2014 Porter
2014/0305442 A1 10/2014 Bergenudd et al.
2014/0305444 A1 10/2014 Kring
2014/0309499 A1 10/2014 Swift
2014/0311498 A1 10/2014 Noras
2014/0316209 A1 10/2014 Overes et al.
2014/0316213 A1 10/2014 Thomas
2014/0318550 A1 10/2014 Doci et al.
2014/0326251 A1 11/2014 Trentacosta
2014/0326841 A1 11/2014 Goodheart
2014/0330083 A1 11/2014 O'Neil et al.
2014/0330084 A1 11/2014 Koteles, Jr. et al.
2014/0330085 A1 11/2014 Hawkins et al.
2014/0330086 A1 11/2014 Mire et al.
2014/0330182 A1 11/2014 Kilbey
2014/0336468 A1 11/2014 Pfabe et al.
2014/0336471 A1 11/2014 Pfabe et al.
2014/0345059 A1 11/2014 Mellberg et al.
2014/0345625 A1 11/2014 Abdoli-Eramaki
2014/0350347 A1 11/2014 Karpowicz et al.
2014/0352070 A1 12/2014 McGann
2014/0352699 A1 12/2014 Born
2014/0357946 A1 12/2014 Golden et al.
2014/0361133 A1 12/2014 Abu-Ulba
2014/0364696 A1 12/2014 Blurton et al.
2014/0364697 A1 12/2014 Son
2014/0364698 A1 12/2014 Nadershahi et al.
2014/0366357 A1 12/2014 Haarburger
2014/0366888 A1 12/2014 Phlegar
2014/0366889 A1 12/2014 Riley
2014/0371539 A1 12/2014 Ahluwalia
2014/0371540 A1 12/2014 Hutton et al.
2014/0371541 A1 12/2014 Friedrich et al.
2014/0375456 A1 12/2014 Sonnendorfer et al.
2014/0378771 A1 12/2014 St. Onge et al.
2014/0378774 A1 12/2014 Wooster
2014/0378775 A1 12/2014 Bowman et al.
2015/0000043 A1 1/2015 Scarleski
2015/0000679 A1 1/2015 Cuypers et al.
2015/0005584 A1 1/2015 Wilkins et al.
2015/0005614 A1 1/2015 Heggeness et al.
2015/0007828 A1 1/2015 Hiebert
2015/0007829 A1 1/2015 Davis
2015/0252972 A1 9/2015 Jiang
2016/0296401 A1 10/2016 Cole et al.

FOREIGN PATENT DOCUMENTS

WO 1995010389 A1 4/1995
WO 2015018922 A1 2/2015

OTHER PUBLICATIONS

International Search Report and Written Opinion for Application No. PCT/US2015/019436 dated May 20, 2015.
Australian Search Report for Application No. 2015229719 dated Oct. 13, 2016.

* cited by examiner

LIMB POSITIONING SYSTEM

CROSS-REFERENCE TO RELATED APPLICATION

The present application claims the benefit of the filing date of U.S. Provisional Patent Application No. 61/950,491 filed Mar. 10, 2014, the disclosure of which is hereby incorporated herein by reference.

BACKGROUND

This disclosure relates generally to a positioning system used to position body parts, such as a knee, during a medical or surgical procedure. The term knee, as used herein, is intended to be synonymous with a knee joint. More particularly, the system is used to first position the bones of the knee in a desired position and orientation. The position of the knee can be adjustably set along a plurality of different axes. Once the position of the knee is set, the system holds the knee in that position and orientation to facilitate the performance of a procedure on the patient. Although the particular embodiments described herein are described in relation to positioning a patient's knee, it should be understood that one of ordinary skill in the art could modify the concepts herein for positioning other parts of the body.

When a medical or surgical procedure is performed on a limb, such as an arm or leg, it may be desirable to restrict movement of the limb. Without holding the limb steady, it can become extremely difficult for the practitioner to perform procedures on the limb with precision. Further, with an increasing frequency, surgical procedures are performed with the aid of surgical navigation systems. This type of system often includes one or more trackers and a camera, for example.

In one version of such a system, at least one tracker is attached to the patient. Based on the signals emitted by the tracker, the camera and associated software determines the position of the tracker. By extension, this leads to the determination of the position of the attached patient. (Some surgical navigation systems have trackers with units that, instead of emitting energy, track energy emitted from the static source.) For many surgical navigation systems to operate, the trackers and camera must be in close proximity to each other. This means that it may be necessary to restrain the movement of the limb so that the tracker and complementary camera are able to engage in the appropriate signal exchange. Such surgical navigation systems are described more fully in U.S. Pat. No. 7,725,162, titled "Surgery system," the entire contents of which are hereby incorporated by reference herein.

Presently there are a number of different devices that can be used to hold the limb of the patient. These devices include some sort of shell or frame designed to receive the limb. Structural members hold the shell or frame to the operating table. At the start of the procedure, the patient's limb is placed in the shell. The shell is positioned at a location which preferably provides the practitioner with sufficient access to perform the procedure. If a navigation unit is used to facilitate the procedure, the shell is further positioned to ensure that any components of the system fitted to the patient are within the appropriate range to the complementary static components of the system. One particular limb positioning system is described in U.S. Patent Publication No. 2013/0019883, the disclosure of which is hereby incorporated by reference herein.

Some available limb holders are able to hold the limb of the patient in a fixed position, for example. However, there are limitations associated with some of these limb holders. Sometimes during a procedure, the practitioner may want to move a portion of the patient. For example, during some orthopedic surgical procedures on the knee, the practitioner may want to bend the knee so that the patient's leg is moved between the extended (straight) and flexed (bent) positions. Some available limb holders are designed so that, to move the limb, the actual limb holding component is temporarily disconnected from the other components of the assembly. This means that, to reposition the limb, the limb holder is first disconnected and then moved. Once the limb holder is repositioned it is reattached to the other assembly components. Having to perform all these steps makes repositioning the limb a complicated task.

Still other limb holder assemblies comprise components that only allow the attached limb to be move in between a number of defined positions. This means that the practitioner may not be able to make precise or small adjustments of limb positioned that may be desired in order to accomplish a particular medical or surgical procedure.

Also, prior to placing the patient on a surgical table, it is common practice to place a sterile drape on the table. This drape functions as a sterile barrier. Some available limb holders are designed to be attached directly to the tables with which the holders are used. At the location where this type of limb holder is attached it is difficult, if not impossible to, place the drape around and/or under the limb holder so as to provide the desired sterile barrier. Additionally, devices attached over sterile drapes may be likely to rip or tear the sterile drape, causing a loss of the desired sterile barrier.

BRIEF SUMMARY OF THE INVENTION

In one embodiment, a limb positioning system includes a clamp assembly, a pylon and bar assembly, a sled assembly, and a limb positioning assembly. The clamp assembly may be configured to attach to a variety of differently sized and shaped bed rails of a surgical table, and may be configured to accept a pylon connected to a bar. The pylon may have a plurality of pylon bars that are secured by the clamp assembly, helping to reduce the amount of torque placed on the clamp assembly during use. A base bar may extend from the pylon, and may be attachable to an extension bar to provide a longer track along which the sled assembly may slide. The sled assembly may be biased to be locked with respect to the base bar, such that a user must depress a lever to allow the sled to slide along the bar. The limb holding assembly may include a boot coupled to the sled via a connector near the heel of the boot. The connector may be tapered and insertable into a correspondingly tapered section of a ball that sits within the sled assembly. The connector may be rotationally locked with respect to the ball, with the ball being capable of polyaxial rotation with respect to the sled. The ball may be locked or unlocked to restrict or allow the polyaxial motion.

In another embodiment of the disclosure, a limb positioning system may include a clamp attachable to a patient support, a first support member slidingly coupled to the clamp about a first longitudinal axis, and a second support member slidingly coupled to the first support member about a second longitudinal axis transverse to the first longitudinal axis. The system may also include a limb holder polyaxially and hingedly coupled to the second support member, and a support wing adjustably coupled to the limb holder. The system may further include a mount polyaxially coupled to the second support member, wherein the limb holder is hingedly coupled to the mount. The limb holder may be detachably coupled to the mount. A tapered connector member may be coupled at one end thereof to the limb holder and another end thereof may be engageable to a corresponding tapered recess in the mount. A height adjustment member may be coupled to a rear of the limb holder, wherein the support wing is adjustably coupled to the height adjustment member. Top and bottom jaws of the clamp may be pivotably coupled, wherein movement of a shaft of an actuator of the clamp in proximal and distal linear directions rotates the bottom jaw about a pivot point in respective clockwise and counterclockwise directions. The shaft of the actuator may be pivotably coupled the bottom jaw. First and second apertures may be formed by the coupling of a body member of the clamp to the top and bottom jaws thereof. The first support member may include first and second pylons extending outwardly from an elongate rod, the first and second pylons being receivable in the first and second apertures to couple the first support member to the clamp. The second support member may have locked and unlocked states with respect to the first support member, the second support member being in the unlocked state when a lever is depressed to allow a sled portion of the second support member to slide along the first support member. The support wing may have attachment features for coupling a retractor to the support wing, and the system may include a retractor coupled to the support wing. At least a portion of the support wing may be at least partially circular with a virtual center configured to align with a center of a joint of a limb positioned in the limb holder. The system may further include a tracking system, wherein a component of the tracking system is mountable to the support wing.

According to another embodiment of the disclosure, a limb positioning system includes a clamp attachable to a patient support, the clamp having first and second channels. A first support member may include first and second pylons extending outwardly from an elongate rod, the first and second pylons being receivable in the first and second channels to slidingly coupled to the first support member to the clamp about a first longitudinal axis. A second support member may be slidingly coupled to the first support member about a second longitudinal axis transverse to the first longitudinal axis. A limb holder may be coupled to the second support member. The limb holder may be polyaxially and hingedly coupled to the second support member. A mount may be polyaxially coupled to the second support member, wherein the limb holder is hingedly coupled to the mount. The limb holder may be detachably coupled to the mount. A height adjustment member may be coupled to a rear of the limb holder, and a support wing may be adjustably coupled to the height adjustment member.

According to yet another embodiment of the disclosure, a limb positioning system may include a clamp attachable to a patient support, and first and second support members. The first support member may be slidingly coupled to the clamp about a first longitudinal axis, and the second support member may be slidingly coupled to the first support member about a second longitudinal axis transverse to the first longitudinal axis. A limb holder may be coupled to the second support member, and a height adjustment member may be coupled to a rear of the limb holder. A support wing may be adjustably coupled to the height adjustment member.

DETAILED DESCRIPTION

Figure 1:
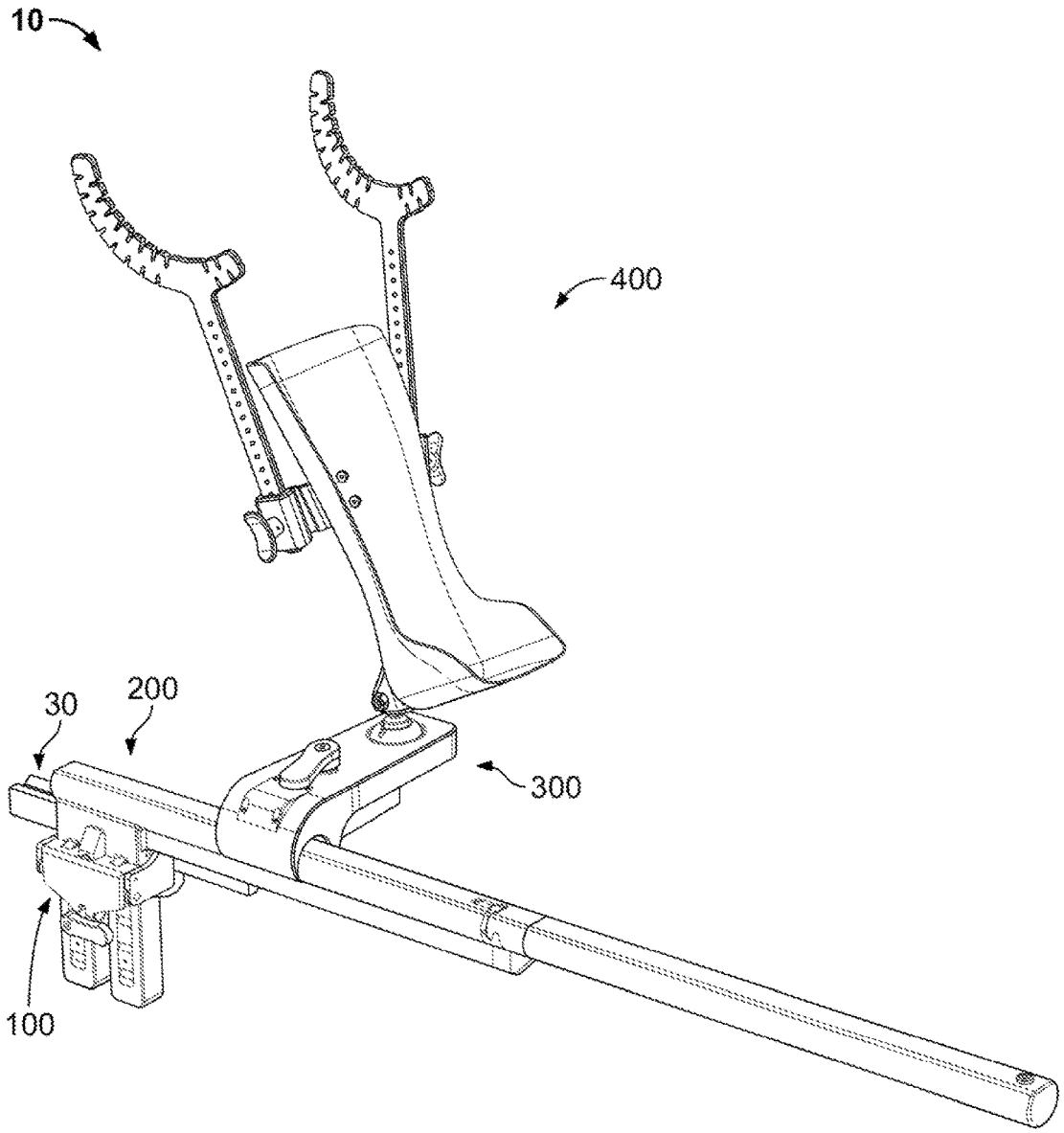
FIG. 1 is a perspective view of a limb positioning system according to an embodiment of the disclosure.

FIG. 1 illustrates one embodiment of a limb positioning system 10. System 10 generally includes a clamp assembly 100, a pylon and bar assembly 200, a sled assembly 300, and a limb holding assembly 400.

The particular system 10 shown in FIG. 1 is shaped to hold the foot and lower leg in any one of a number of positions and orientations relative to an operating table (not illustrated), which holds the remainder of the patient. Other embodiments of system 10 may be shaped to hold other body parts, such as an arm. The term table should be understood to include a table, a bed, or any support structure upon which a patient may be disposed.

Generally, system 10 is mounted to a bed rail 30, a generally rectangular bar that is often fixedly mounted to the side of a surgical table, by way of clamp assembly 100. Bed rail 30 may also be referred to as a DIN rail, based on specifications published by Deutsches Institut für Normung. It should be understood that system 10 may be attached to other types of rails, and to a variety of sizes of bed rails. For example, Europe, Denmark, Japan, Switzerland, the United Kingdom, and the United States may each have bed rails with different standard shapes or sizes, with system 10 being capable of use with all of the above rails.

As seen in FIGS. 2A-E, clamp assembly 100 generally includes an upper jaw 120, a lower jaw 140, a pylon clamp 160, and a clamp knob 180.

Upper jaw 120 may include a generally "J"-shaped clamping finger 122. In other words, clamping finger 122 may include a flange portion 121 with a lip 123 transverse to the flange portion to facilitate gripping one side of bed rail 30. Lips with more or less extreme angles may be used depending on the particular structure to which upper jaw 120 is intended to clamp. The lip may also extend gradually from a recessed portion adjacent the flange and lip portions 121 and 123, rather than at a sharp angle. Upper jaw 120 may include sidewall 124, sidewall 126, and a center wall 128 between first and second sidewall 124, 126. A top portion of upper jaw 120 may include one or more apertures 125*a* and 125*b*, each capable of receiving a post or a portion of a post, such as pylon 220 (described in greater detail below in connection with FIGS. 3A-3D). In the illustrated embodiment, upper jaw 120 includes two apertures 125*a* and 125*b*. Aperture 125*a* is at least partially defined by sidewall 124 and center wall 128. Aperture 125*b* is at least partially defined by sidewall 126 and center wall 128. Although two apertures are illustrated, one aperture or more than two apertures may be used in alternate embodiments of upper jaw 120.

Figure 2A:
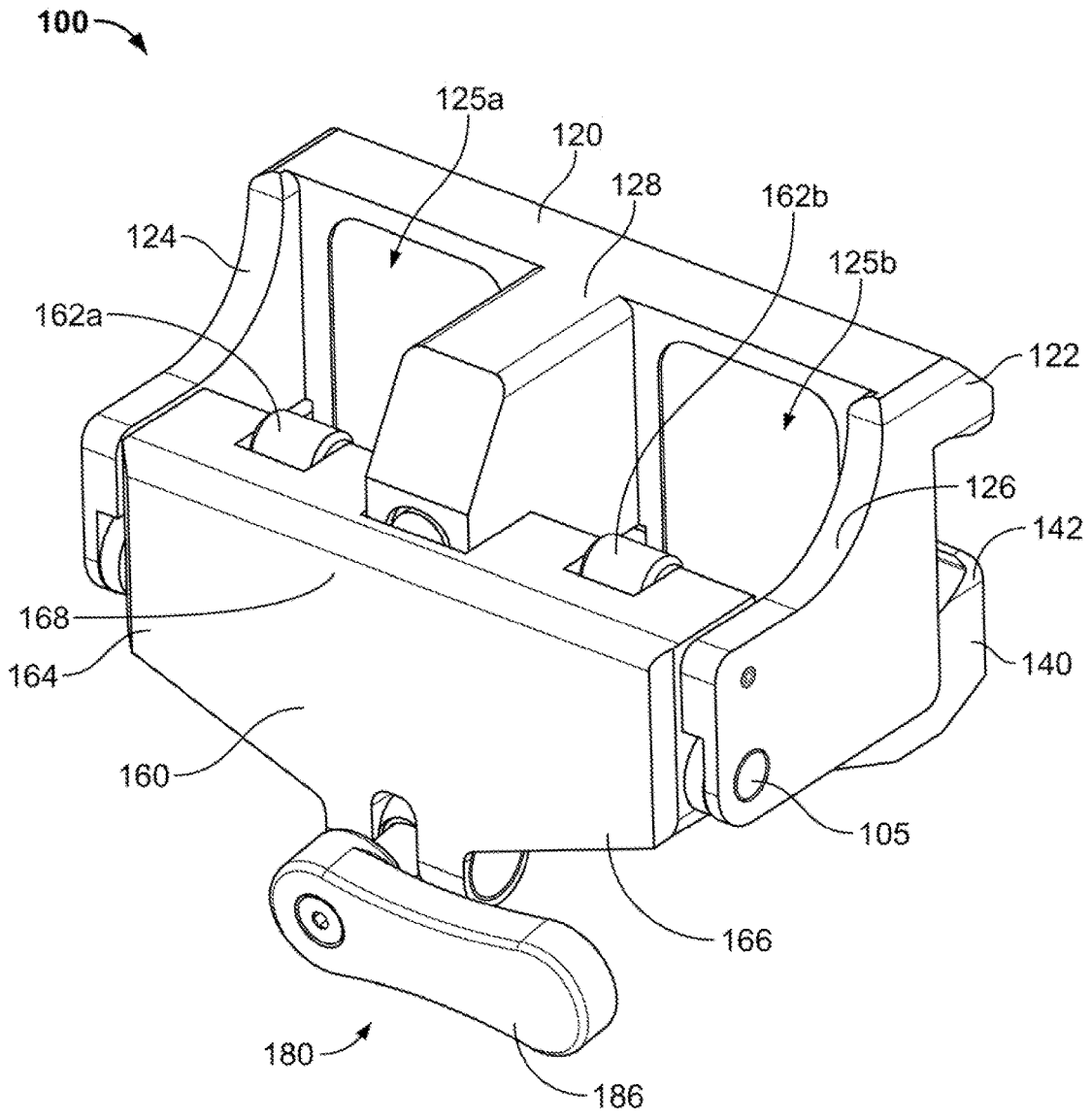
FIG. 2A is a top perspective view of a clamp assembly of the limb positioning system of FIG. 1.
Figure 2B:
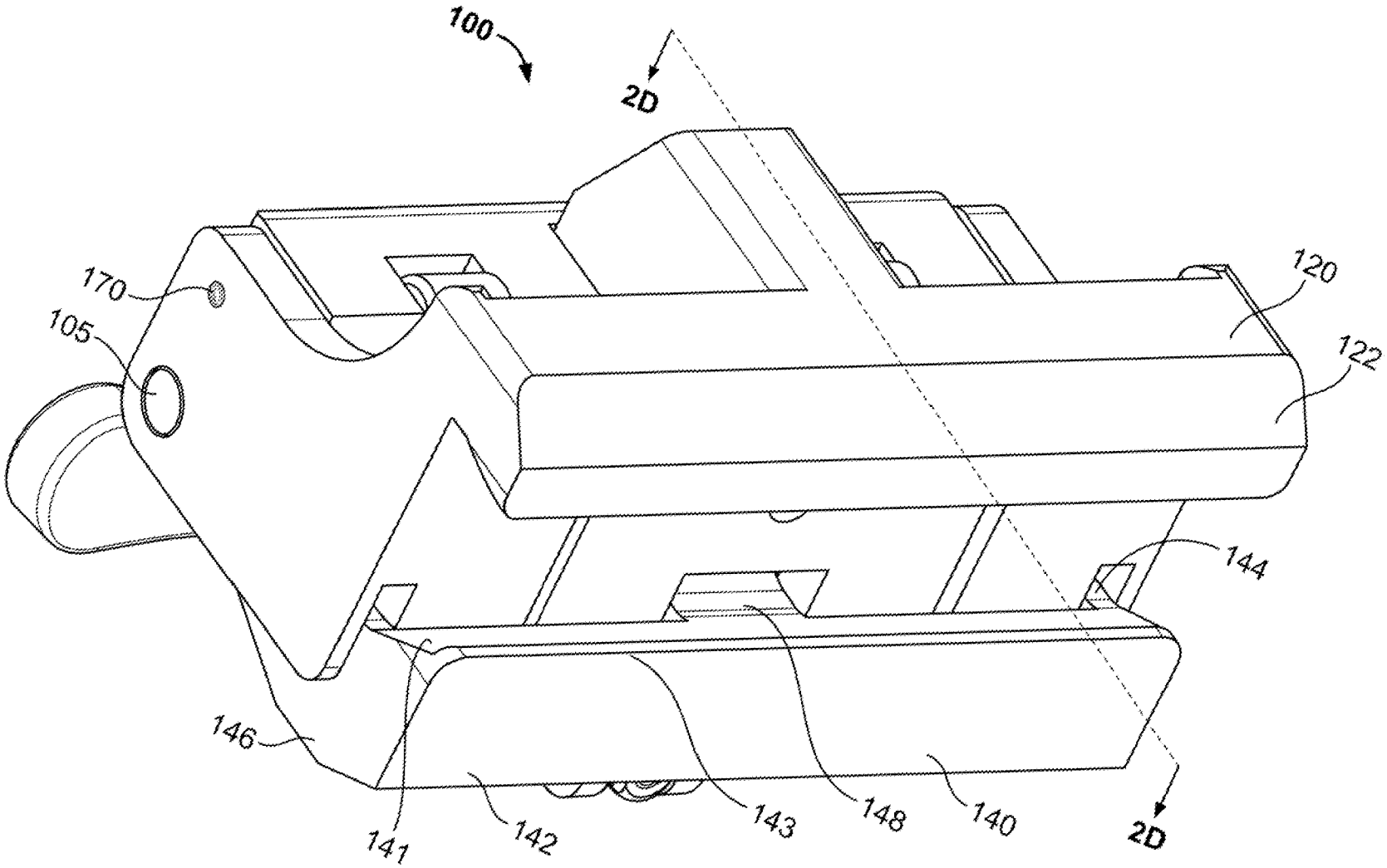
FIG. 2B is a front perspective view of the clamp assembly of FIG. 2A.
Figure 2C:
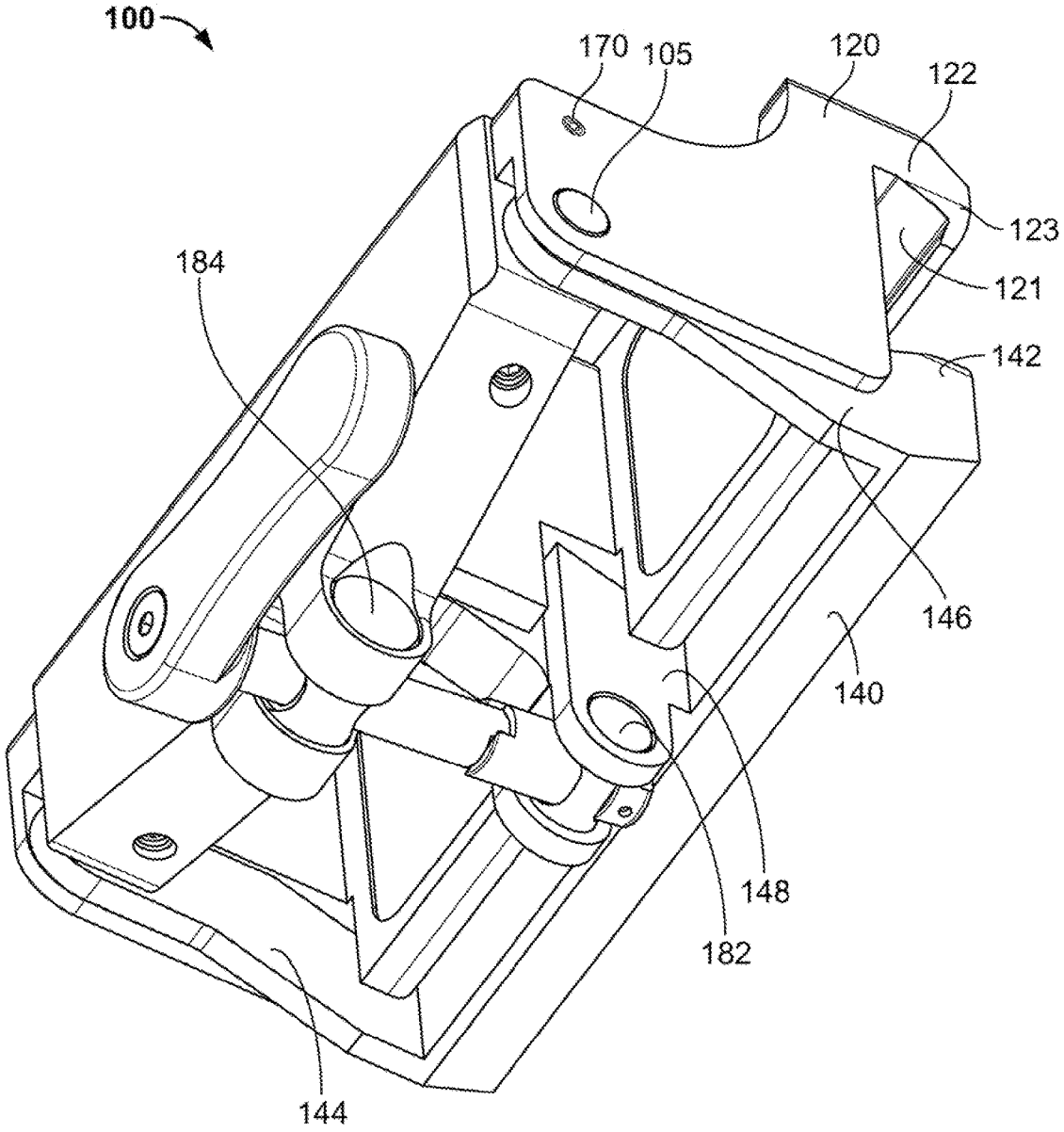
FIG. 2C is a bottom perspective view of the clamp assembly of FIG. 2A.

Lower jaw 140 may include a generally "J"-shaped clamping finger 142. As with upper clamping finger 122, lower clamping finger 142 may include a generally recessed portion adjacent a flange portion 141 with a transverse lip portion 143 designed to facilitate gripping one side of bed rail 30. Lower jaw 140 may include sidewall 144, sidewall 146, and center wall 148. Sidewalls 144 and 146 and center wall 148 of lower jaw 140 may be at least partially positioned within corresponding recesses in upper jaw 120. In particular, as best illustrated in FIG. 2B, sidewall 144 may be positioned within a recess defined at least in part by sidewall 124 of upper jaw 120. Sidewall 146 may be positioned within a recess defined at least in part by sidewall 126 of upper jaw 120. Similarly, center wall 128 may be positioned within a recess defined at least in part by center wall 148.

Upper jaw 120 may be hingedly or pivotably connected to lower jaw 140. For example, sidewall 124 of upper jaw 120 and sidewall 144 of lower jaw 140 may have corresponding apertures configured to accept a pin 105 or other structure about which lower jaw 140 may rotate with respect to upper jaw 120. Similarly, sidewall 126 of upper jaw 120 and sidewall 146 of lower jaw 140 may also have corresponding apertures configured to accept the other end of pin 105 or other structure about which lower jaw 140 may rotate with respect to upper jaw 120. Although a single elongate pin 105 may be used that extends across upper jaw 120 and lower jaw 140, it is contemplated that multiple smaller pins may be used. A bottom portion of center wall 148 of lower jaw 140 may include a pair of extension flanges having corresponding apertures to accept a pin 182 or other structure for coupling to a portion of clamp knob 180, which is described in greater detail below.

Pylon clamp 160 has a first end 164 and a second end 166, with a center portion 168 positioned between first end 164 and second end 166. Pylon clamp 160 may include a recess near the top of center portion 168 into which a portion of center wall 128 of upper jaw 120 is configured to fit. Additional recesses may be formed on either side of the center recess in pylon clamp 160 in which rotatable wheels 162*a* and 162*b* are positioned to facilitate coupling of the pylon into clamp assembly 100. Second end 166 of pylon clamp 160 may include an aperture into which pin 105 extends, such that pylon clamp 160 may rotate with respect to upper jaw 120 and lower jaw 140 about pin 105. A similar aperture may be included in first end 164 of pylon clamp 160 for the same purpose. The bottom end of center portion 168 of pylon clamp 160 may include a pair of extension flanges having corresponding apertures to accept a pin 184 or other structure for coupling to a portion of clamp knob 180, which is described in greater detail below.

Figure 2D:
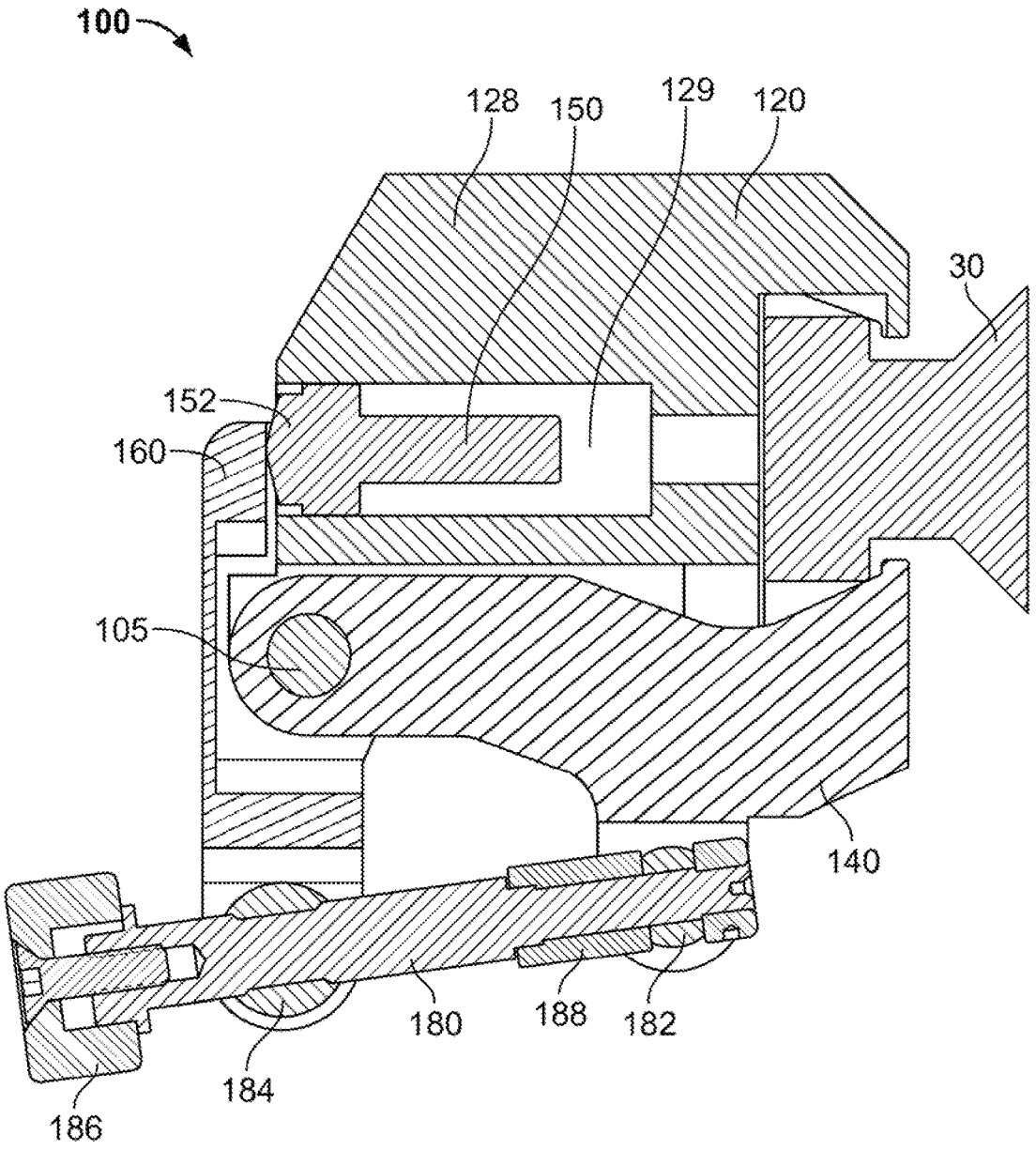
FIG. 2D is a cross-sectional view of the clamp assembly of FIG. 2A taken along line 2D-2D of FIG. 2B.

As best illustrated in FIG. 2D, center wall 128 of upper jaw 120 may include a recess 129 housing a spring pin 150. Spring pin 150 may include a generally cylindrical portion around which a stiff spring (spring not illustrated) may be positioned. A first end of the spring may contact one end of the recess in upper jaw 120, with the other end contacting an enlarged head 152 of spring pin 150. Head 152 of spring pin 150 in turn contacts center portion 168 of pylon clamp 160. This contact biases pylon clamp 160 in an open position with respect to upper jaw 120, maximizing the clearance space in apertures 125*a* and 125*b* for eventual insertion of pylon 200, as described in greater detail below. The degree to which pylon clamp 160 is held open with respect to upper jaw 120 is limited by stop 170 in upper jaw 120.

Still referring to FIG. 2D, clamp knob 180 may generally include a handle 186 and distal housing 188. Distal housing 188 may be fixedly positioned within pin 182, which itself is fixed to the extension flanges of center wall 148 of lower jaw 140. A proximal portion of clamp knob 180 may be fixedly positioned within pin 184, which itself is fixed to the extension flanges of center portion 168 of pylon clamp 160. An inner surface of housing 188 may be threaded while an outer surface of a distal portion of clamp knob 180 may include complementary threads, for example. In this configuration, upon rotation of handle 186, the distal portion of clamp knob 180 will thread into or out of housing 188. Because housing 188 is fixed to lower jaw 140 and a proximal portion of clamp knob 180 is fixed to pylon clamp 160, as clamp knob 180 threads into or out of housing 188, the extension flanges of lower jaw 140 move toward or away from the extension flanges of pylon clamp 160, ultimately causing lower jaw 140 to pivot with respect to pylon clamp 160.

To connect clamp assembly 100 to bed rail 30, lower jaw 140 must be pivoted open to a certain extent with respect to upper jaw 120. If there is not enough clearance space for bed rail 30, clamp knob 180 is rotated in a first direction to pivot lower jaw 140 away from upper jaw 120. A user positions upper jaw 120, and particularly finger 122 of upper jaw 120, over the top of bed rail 30. Clamp knob 180 is rotated in the other direction. This causes lower jaw 140 to pivot in an opposite direction as pylon clamp 160. The pivoting of pylon clamp 160 is transmitted to upper jaw 120 because of the contact between pylon clamp 160 and upper jaw 120. This is continued until finger 142 of lower jaw is positioned over the bottom of bed rail 30.

Before continuing to rotate clamp knob 180, upper jaw 120 and lower jaw 140 partially secure clamp assembly 100 to bed rail 30. As upper jaw initially closes 120 closes with respect to lower jaw 140, pylon clamp 160 essentially remains open because it is spring-loaded against stop 170. The degree to which spring pin 150 keeps pylon clamp 160 open may be limited by stop pin 170 which extends through upper jaw 120 and within a recess in pylon clamp 160. The initial closing of lower jaw 140 with respect to upper jaw 120 does not significantly compress the spring surrounding spring pin 150. The spring is compressed (and pylon clamp 160 closed with respect to upper jaw 120), after upper jaw 120 and lower jaw 140 are clamped to the bed rail 30 and the rotation of clamp knob 180 is then continued. This is because as pylon clamp 160 continues to close, upper jaw 120 is pressed against bed rail 30 and can no longer rotate in sync with pylon clamp 160. One benefit of keeping pylon clamp 160 open during the initial clamping of upper jaw 120 and lower jaw 140 to bed rail 30 is to allow pylon 200 to be easily be inserted through apertures 125*a* and 125*b* of upper jaw 120, as described in greater detail below in connection with FIGS. 3A-D.

Figure 2E:
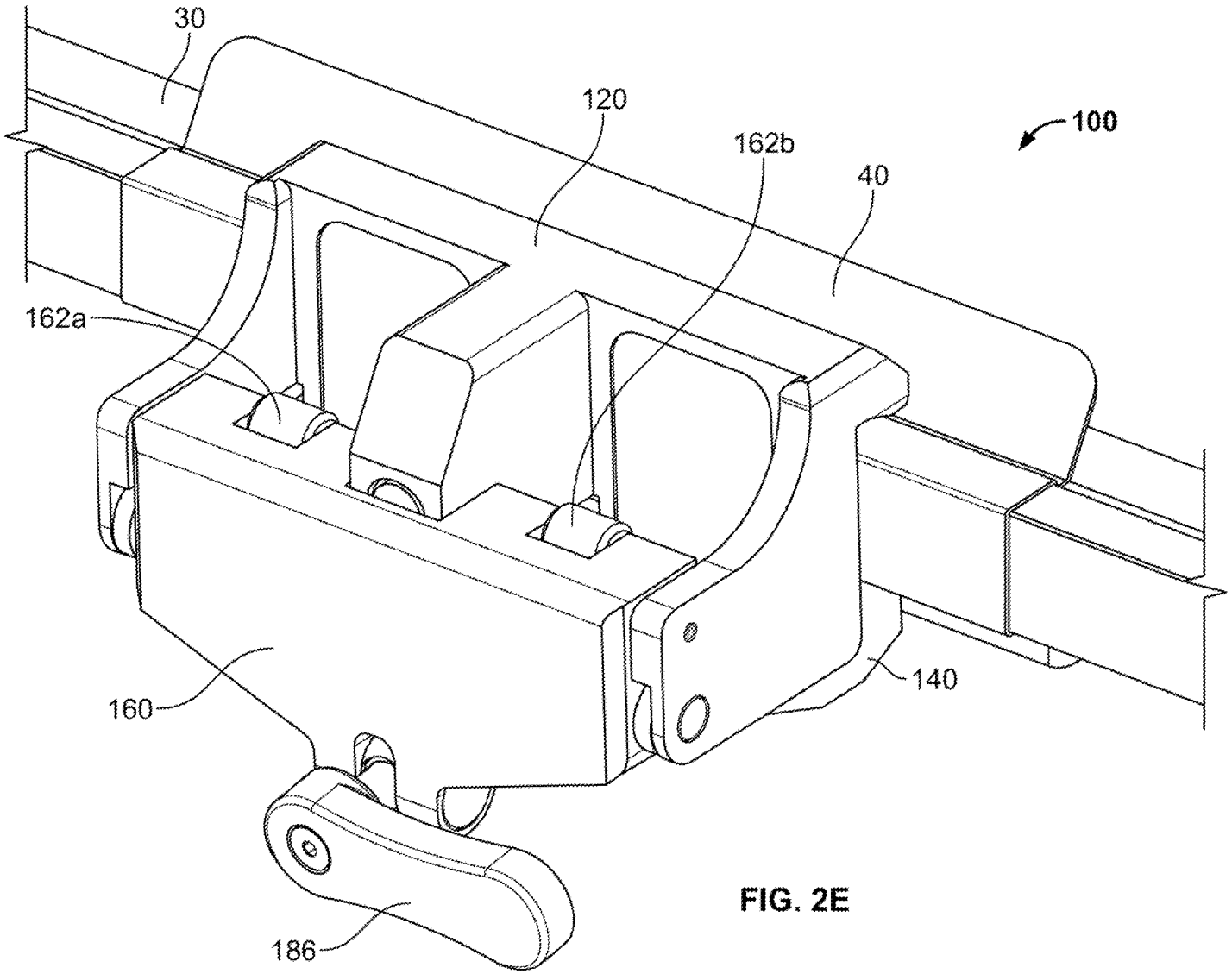
FIG. 2E is a top perspective view of the clamp assembly of FIG. 2A, used with a padding, attached to a bed rail.

During a typical surgical procedure, a patient positioned on a surgical table will often have a sterile drape or other sterile covering draped over the patient's body. Preferably, clamp assembly 100 is clamped to bed rail 30 over the sterile drape so as to maintain a sterile working field. The surfaces of upper jaw 120 and lower jaw 140 which clamp onto bed rail 30 have the potential to cut, rip, or otherwise tear the sterile drape, disrupting the sterile field. In one embodiment, at least a portion of upper jaw 120 and lower jaw 140, preferably the portions intended to contact bed rail 30, may include padding 40, or a buffer material, to reduce the likelihood of tearing the sterile drape, as illustrated in FIG. 2E. Padding 40 may take the form of a disposable insert such that, after each use, the padding may be discarded without the need to re-sterilize the padding. Preferably, the padding 40 is a strong, inexpensive material, such as a tarp material or a para-aramid synthetic fiber, such as that sold under the trade name Kevlar. Other materials that may be suitable include, for example, Parylene, polyurethanes, vinyl acetates, alkyds, polyesters, polyamides, or polyimides formed into thin sheets.

Pylon and bar assembly 200 may be coupled to clamp assembly 100 as illustrated in FIGS. 1 and 3A-C. Generally, pylon and bar assembly includes pylon 220, base bar 240, and extension bar 260 (extension bar illustrated best in FIGS. 1 and 3E-H).

Pylon 220 may include a first pylon bar 222*a* and a second pylon bar 222*b*. Pylon bar 222*a* is generally rectangular and extends at a substantially perpendicular angle from an end portion of base bar 240. Pylon bar 222*b* extends from base bar 240 at a spaced distance from pylon bar 222*a*, but in all other respects is substantially identical to pylon bar 222*a*. Pylon bars 222*a* and 222*b* serve to mount base bar 240 to the operating table, via clamp assembly 100, to support sled assembly 300, limb holding assembly 400, and a patient's limb held therein. Because base bar 240 (and extension bar 260, if being used) extends a distance substantially orthogonally to pylon bars 222*a* and 222*b*, weight from base bar 240 (and extension bar 260), sled assembly 300, limb holding assembly 400, and any limb held therein may have the potential to create a relatively large amount of torque on pylon 220 within clamp assembly 100. By using a relatively wide pylon 200, for example by having two pylon bars 222*a* and 222*b* positioned at a spaced distance, torque in the pylon 200 becomes less of a potential issue than if pylon 200 consisted of a single relatively thin structure. Although two pylon bars 222*a*, 222*b* are illustrated, other alternates may be possible, such as a relatively wide single pylon bar, or more than two pylon bars. It should be noted that clamp assembly 100 may need to have an alternate configuration for coupling to other types of pylons.

Pylon bar 222*a* may include a plate insert 230 with a plurality of notches 232*a*. The plate may be a separate piece of material welded or otherwise attached to pylon bar 222*a*, or the notches 232*a* may be integral with pylon bar 222*a*. Each notch 232*a* may be curved, substantially forming a portion of a circle. The notches 232*a* may be equally spaced along pylon bar 222*a*, although varying spacing may be used if desired. Another set of notches 232*a* may be positioned on the opposite surface of pylon bar 222*a*. Pylon bar 222*b* may contain a similar set of notches 232*b*. Preferably, the spacing of notches 232*a* with respect to pylon bar 222*a* is substantially identical to the spacing of notches 232*b* with respect to pylon bar 222*b*. If plate inserts are used on each side of pylon bar 222*a* or 222*b*, they may be connected to one another, for example by connecting screw 223*b* illustrated in FIG. 3D.

As noted above in connection to FIGS. 2A-E, prior to coupling pylon and bar assembly 200 to clamp assembly 100, upper jaw 120 and lower jaw 140 are partially secured to bed rail 30, with pylon clamp 160 in a relatively open position with respect to upper jaw 120. At this point, clamp assembly may be secured to bed rail 30 such that it will remain coupled to bed rail 30 without the user's intervention, although it may not be fully secure at this point. With the pylon clamp 160 in a relatively open position (up to stop 170) with respect to upper jaw 120, the user may couple pylon 220 to clamp assembly 100. To accomplish this, the user inserts pylon bar 222*a* into aperture 125*a* and pylon bar 222*b* into aperture 125*b* simultaneously. Upper jaw 120 and pylon clamp 160 are dimensioned such that as pylon bars 222*a* and 222*b* enter apertures 125*a* and 125*b*, wheels 162*a* and 162*b* of pylon clamp 160 contact pylon bars 222*a* and 222*b*, respectively, rotating as the pylon bars 222*a* and 222*b* move further into the apertures 125*a* and 125*b*. As wheels 162*a* and 162*b* rotate against the moving pylon bars 222*a* and 222*b*, they successively engage notches 232*a* and 232*b*. As wheels 162*a* and 162*b* enter a particular pair of notches 232*a* and 232*b*, tactile and/or auditory feedback will alert the user that the wheels 162*a* and 162*b* have "clicked" into a particular pair of notches 232*a* and 232*b*. Each pair of notches 232*a* and 232*b* provides a different height at which base bar 240 may be set with respect to bed rail 30. The wheels 162*a* and 162*b* may or may not be spring loaded against pylon 220.

Figure 3A:
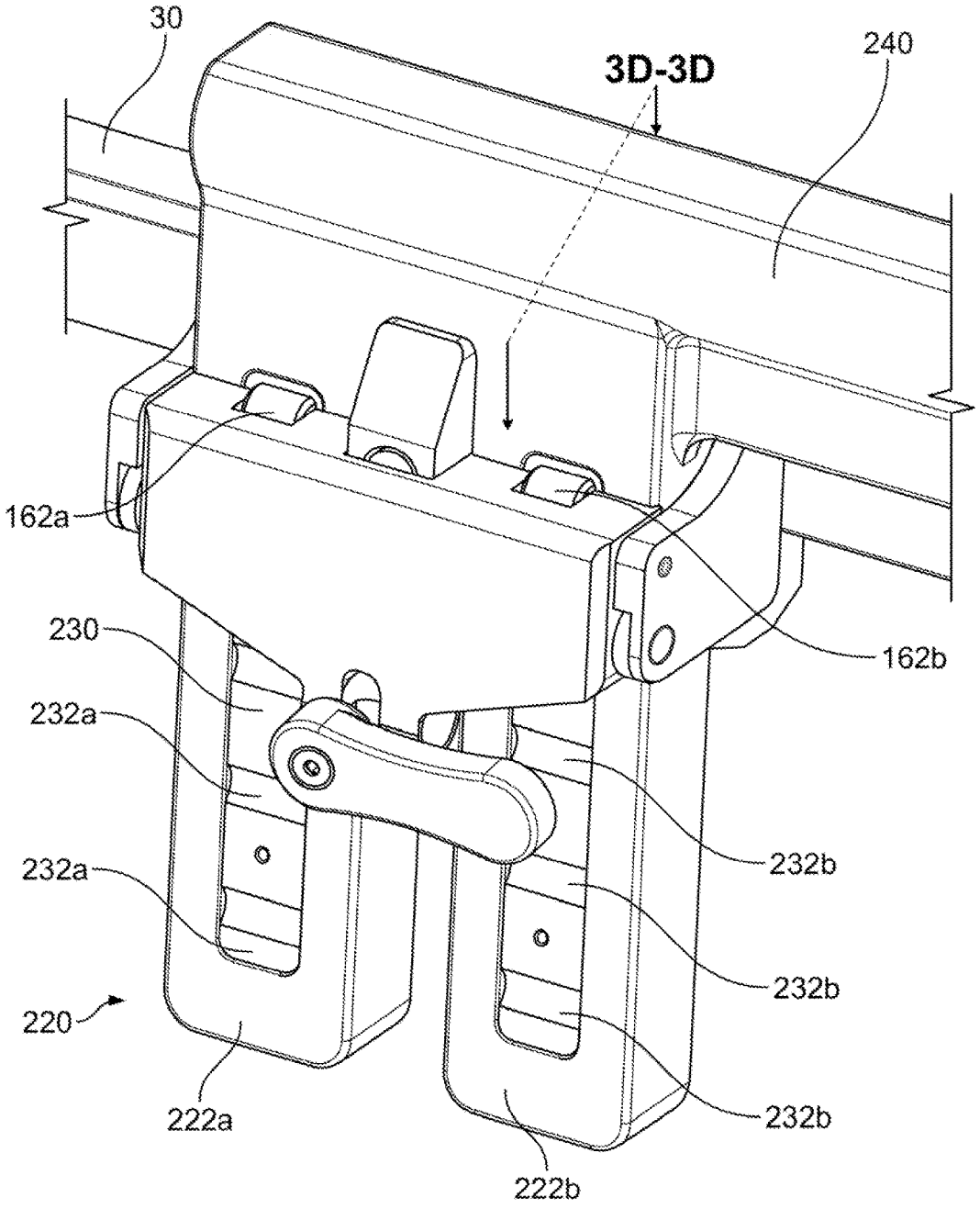
FIG. 3A is a top perspective view of a pylon of a bar assembly and a bed rail coupled to the clamp assembly of FIG. 2A.
Figure 3B:
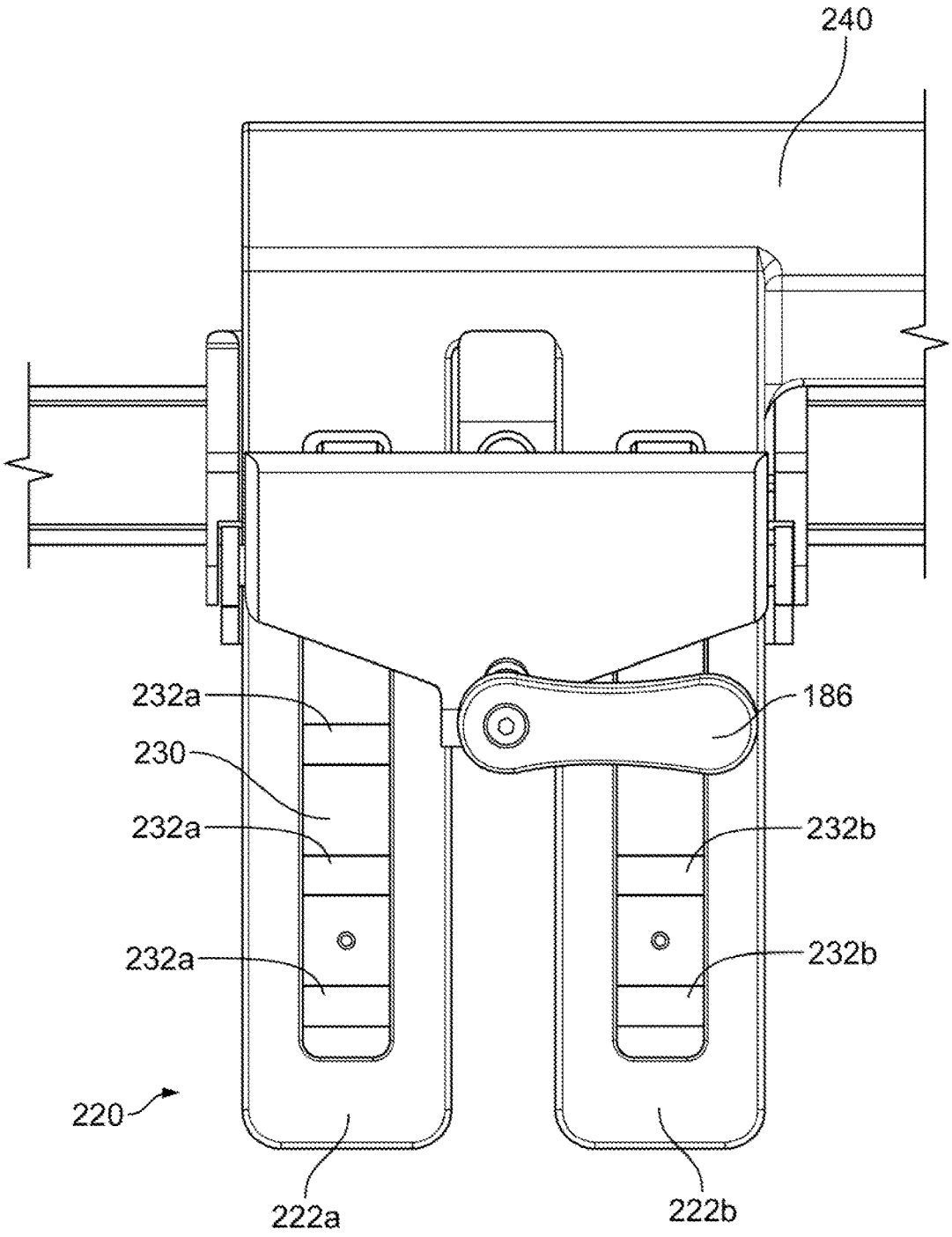
FIG. 3B is a front view of the pylon coupled to the clamp assembly.
Figure 3C:
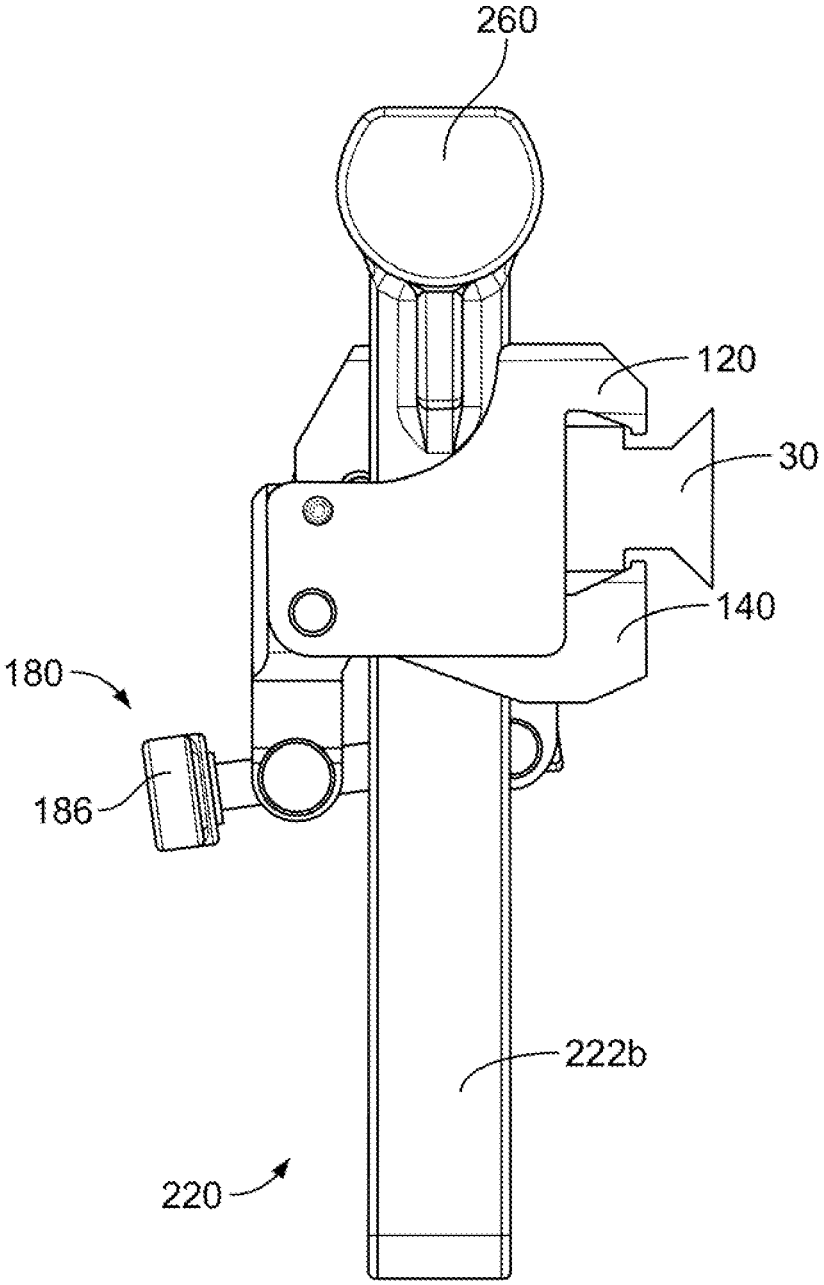
FIG. 3C is a side view of the pylon coupled to the clamp assembly.
Figure 3D:
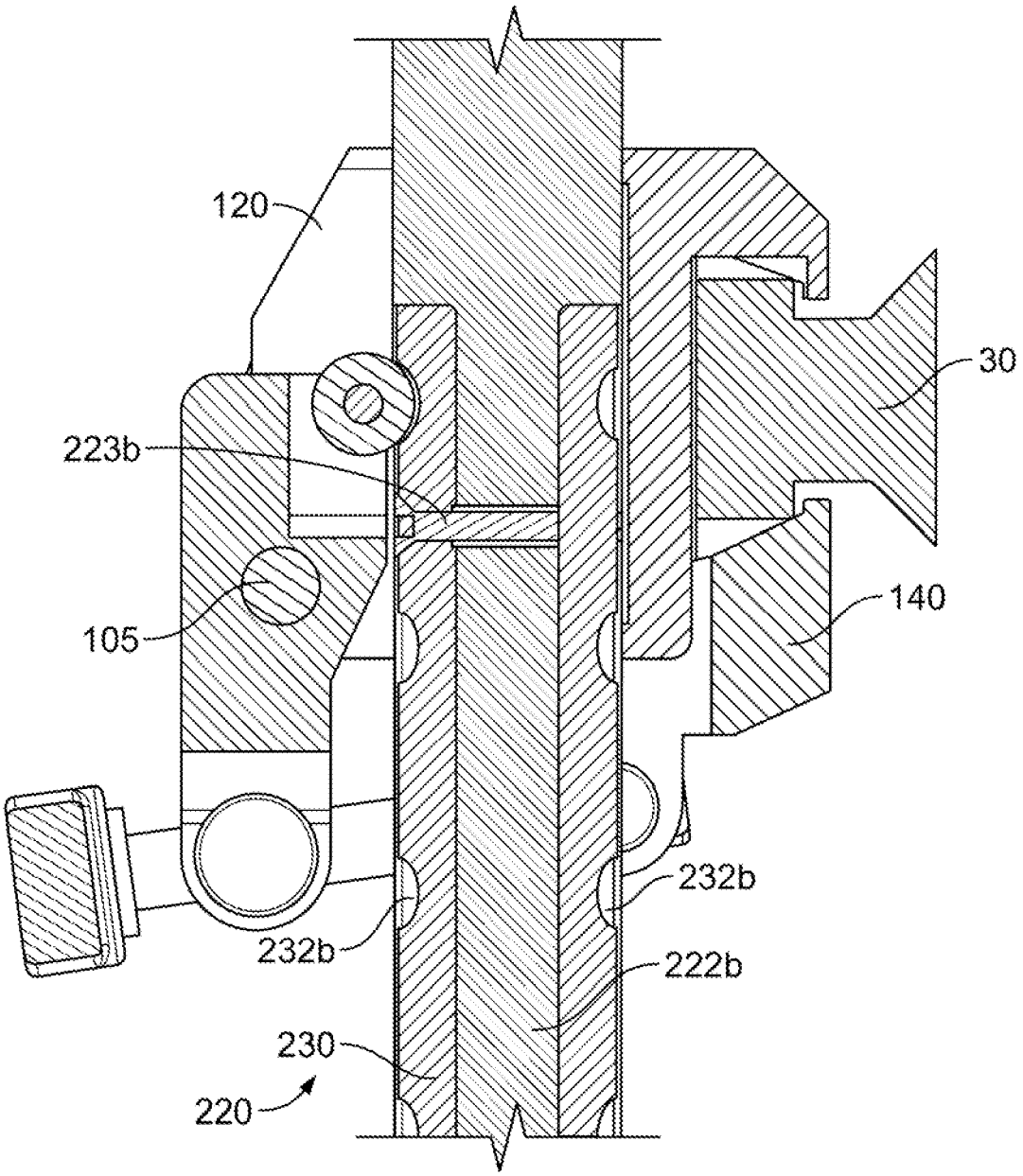
FIG. 3D is a cross-sectional view of the pylon coupled to the clamp assembly taken along line 3D-3D of FIG. 3A.

Once the pylon bars 222*a* and 222*b* and wheels 162*a* and 162*b* are positioned within the desired pair of notches 232*a* and 232*b* with the base bar 240 at the desired height, the user may continue to rotate handle 182 of clamp knob 180. As best illustrated in FIGS. 2D and 3C-D, further rotation of clamp knob 180 causes lower jaw 140 to pivot further closed with respect to upper jaw 120, fully locking clamp assembly 100 to bed rail 30. Once clamp assembly 100 is fully locked to bed rail 30, the pivoting motion of pylon clamp 160 cannot be meaningfully transferred to upper jaw 120, as upper jaw 120 is locked onto bed rail 30. As a result, further rotation of clamp knob 180 causes pylon clamp 160 to pivot further toward upper jaw 120 and further compress the stiff spring surrounding spring pin 150. As pylon clamp 160 further pivots, pylon clamp 160 and the wheels 162*a* and 162*b* further press into the respective pylon bars 222*a* and 222*b*, locking pylon 220 into clamp assembly 100 at the desired height.

Figure 3E:
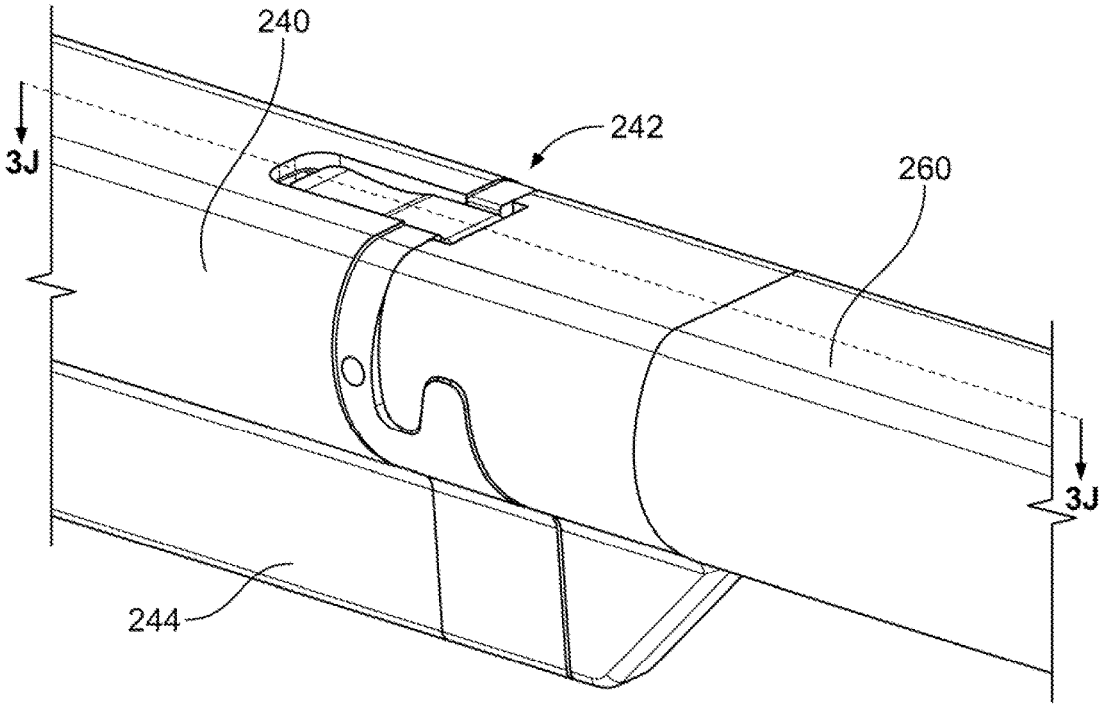
FIG. 3E is a perspective view of a base bar coupled to an extension bar.

FIG. 3E illustrates base bar 240 along with optional extension bar 260 attached thereto. As noted above, a first end of base bar 240 terminates in pylon 220, with the opposite end terminating in first connector portion 242. Generally, base bar 240 is a generally elongate cylindrical bar with a flattened top. The bottom of base bar 240 may include a relatively thin flange 244 running part or all of the length of base bar 240. Flange 244 may provide additional support for extension bar 260, if attached to base bar 240, and may also serve to stiffen base bar 240. Base bar 240 provides a trajectory along which sled assembly 300, described in greater detail below in connection with FIGS. 4A-C, may slide. If a user desires for a longer path, he may connect extension bar 260 to base bar 240.

Figure 3F:
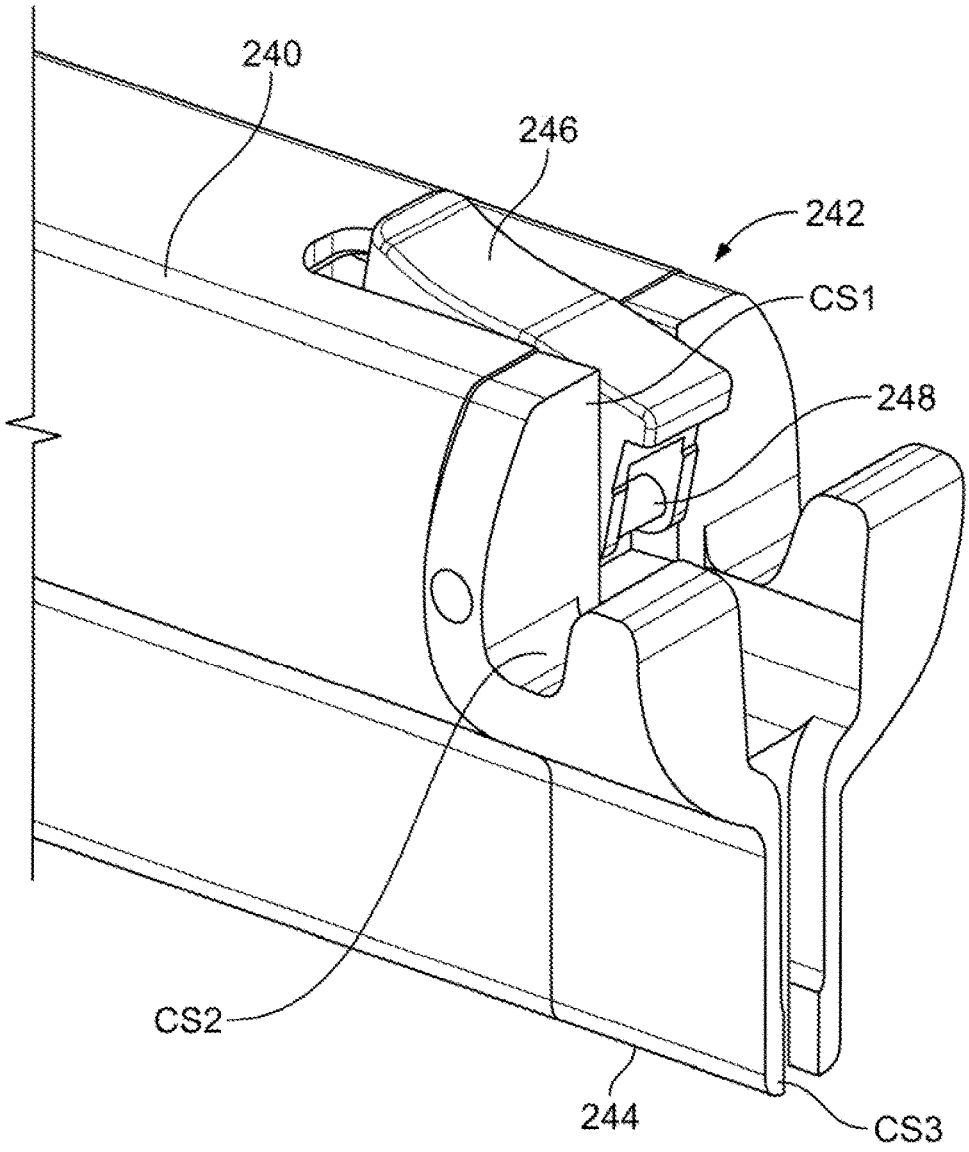
FIG. 3F is a perspective view of an end of the base bar.

First connector portion 242 of base bar 240 is illustrated in greater detail in FIG. 3F with extension bar 260 detached. First connector portion 242 includes a coupling latch 246. Coupling latch 246 may be at least partially positioned within a recess extending from base bar 240 to first connector portion 246. Coupling latch 246 may include an aperture through which pin 248 extends, such that coupling latch 246 is connected to first connector portion 246 via a pin 248 about which coupling latch 246 may pivot. A spring may be positioned in the recess between base bar 240 and coupling latch 246, such that coupling latch 246 is biased in the clockwise direction with reference to FIG. 3F. First connector portion 242 may include a number of contact surfaces for coupling to second connector 262 of extension bar 260 (as described in greater detail below). In this particular embodiment, first connector portion 242 includes two generally dovetailed shapes separated by a centering recess. The slightly angled portions of first connector portion 242 define a first contact surface CS1, while the curved portions define a second contact surface CS2. Flange 244 terminates at first connector portion 242, defining a third contact surface CS3, providing additional surface area for contact between first connector portion 242 of base bar 240 and second connector portion 262 of extension bar 260.

Figure 3G:
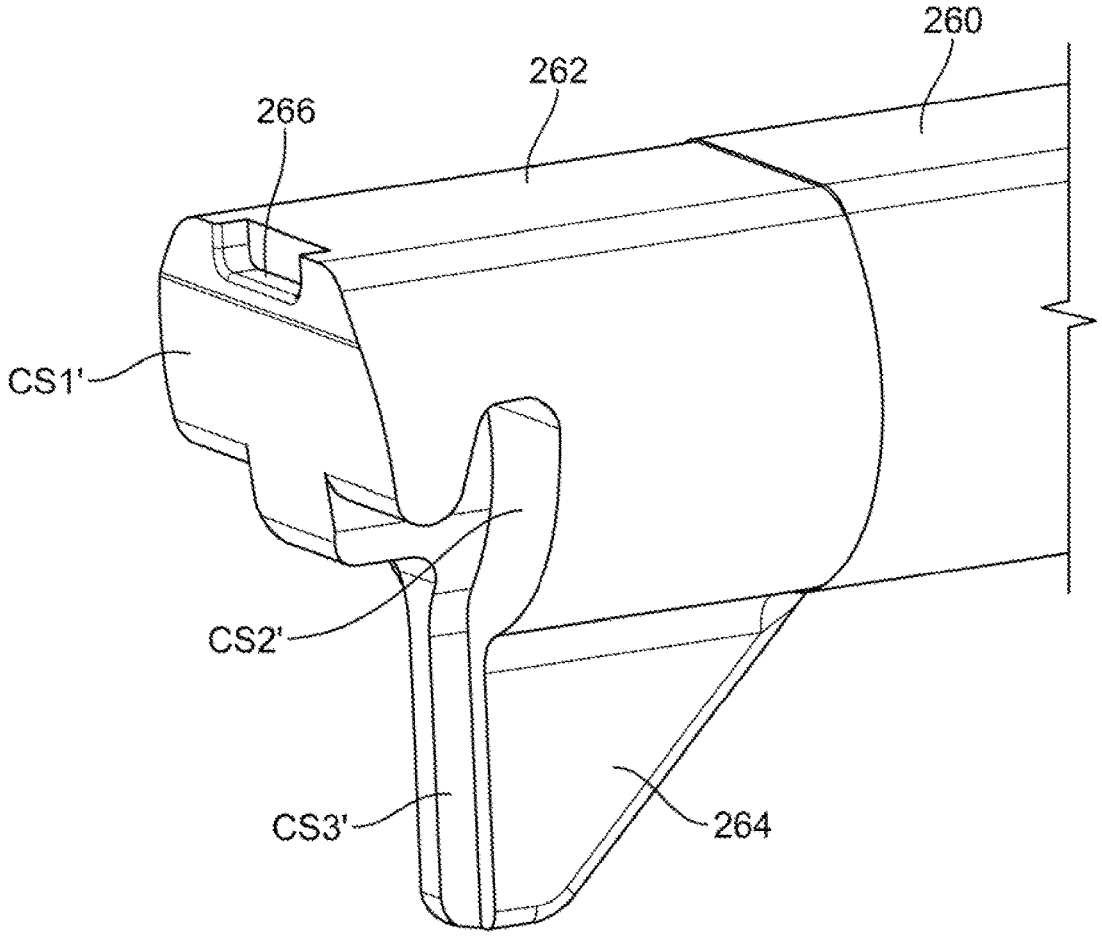
FIG. 3G is a perspective view of an end of the extension bar.

FIG. 3G illustrates second connector portion 262 of extension bar 260 in greater detail. Second connector portion 262 may take any shape complementary to first connector portion 242. In this embodiment, second connector portion includes two recesses separated by a centering protrusion. A relatively flat end of second connector portion 262 defines first contact surfaces CS1' configured to be in contact with the first contact surface CS1 of first connector portion 242. The curved portion defines a second contact surface CS2' configured to be in contact with the second contact surface CS2 of first connector portion 242. Second connector portion 262 may also include a flange 264 defining a third contact surface CS3' that contacts flange 244 and contact surface CS3 of base bar 240. Second connector portion further includes a coupling latch recess 266 configured to mate with coupling latch 246.

Figure 3H:
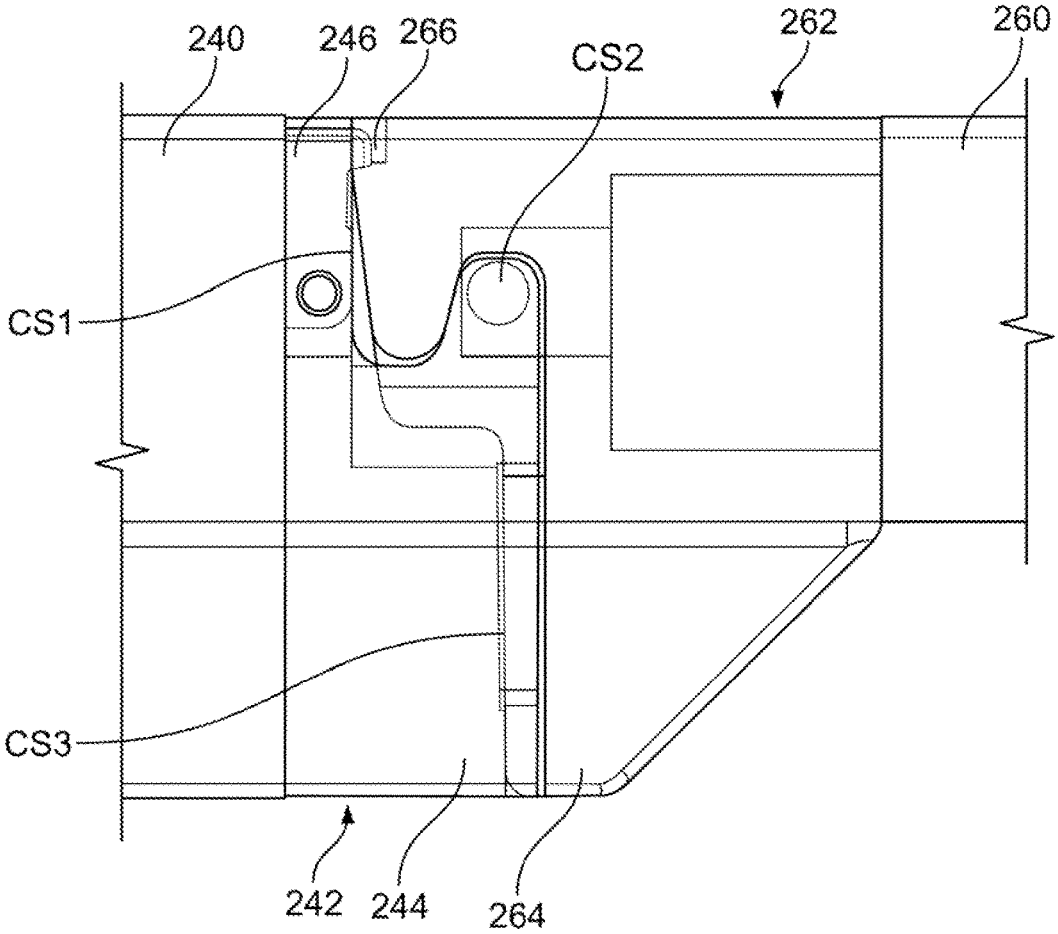
FIG. 3H is an enlarged view of a portion of the base bar connected to a portion of the extension bar, shown in partial transparency.

The angle of contact surfaces CS2 and CS2' facilitates the first connector portion 242 coupling to contact surfaces CS1' and CS3' of second connector portion 262, forming a rigid assembled joint with little to no clearance. Base bar 240 is illustrated connected to extension bar 260 in FIG. 3H, with first connector portion 242 and second connector portion 262 in partial transparency. Spring loaded coupling latch 246 is coupled into latch recess 266. When coupled with latch recess 266, the spring in contact with coupling latch 246 is compressed, placing a clockwise force (as illustrated in FIG. 3H) on latch recess 266, keeping extension bar 260 locked to base bar 240. In this position, coupling latch 246 is substantially flush with the top flattened surfaces of base bar 240 and extension bar 260 to allow sled assembly 300 to slide along the bar uninterrupted, as described in greater detail below.

Figure 3I:
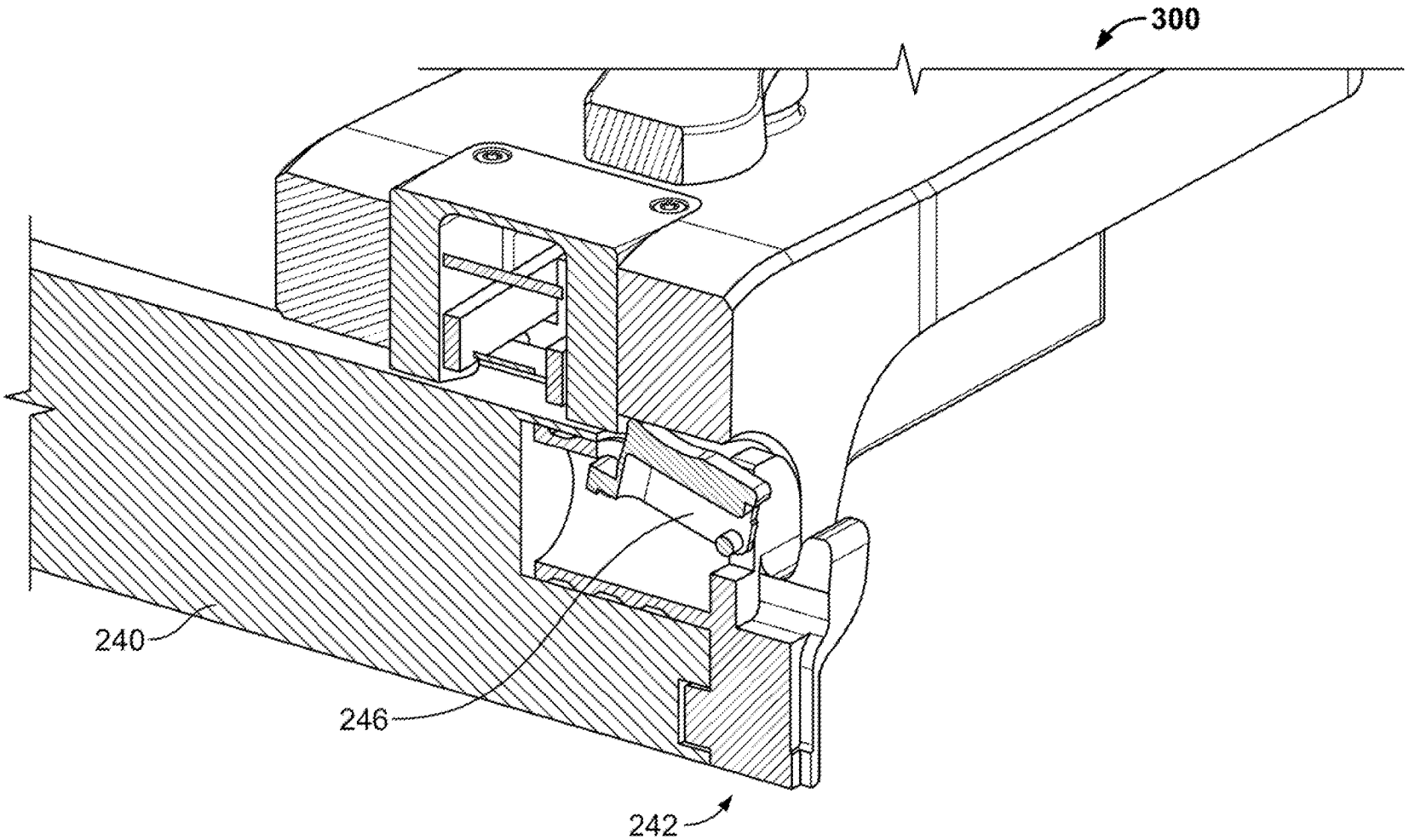
FIG. 3I is a cut-away view of a sled assembly coupled to the base bar.

As noted above, limb positioning system 10 may be used with base bar 240, with or without extension bar 260. A portion of sled assembly 300 is illustrated in FIG. 3I in use with base bar 240, with extension bar 260 disconnected. A user can slide sled assembly 300 (described in greater detail below in connection with FIGS. 4A-C) over first connector portion 242 to attach sled assembly 300 to base bar 240. Coupling latch 246 does not stop sled assembly 300 from sliding onto base bar 240, because coupling latch 246 acts like a spring loaded ramp. The force provided by sled assembly 300 compresses the spring operatively coupled to coupling latch 246, causing coupling latch 246 to rotate into base bar 240 such that sled assembly may slide over coupling latch 246. However, once sled assembly 300 has slid far enough to clear coupling latch 246, coupling latch 246 springs back out of base bar 240. Because of the orientation of coupling latch 246, sled assembly 300 is prevented from sliding off the end of base bar 240 unintentionally. If desired, a user may manually depress coupling latch 246 to allow sled assembly 300 to slide off the end of base bar 240.

Figure 3J:
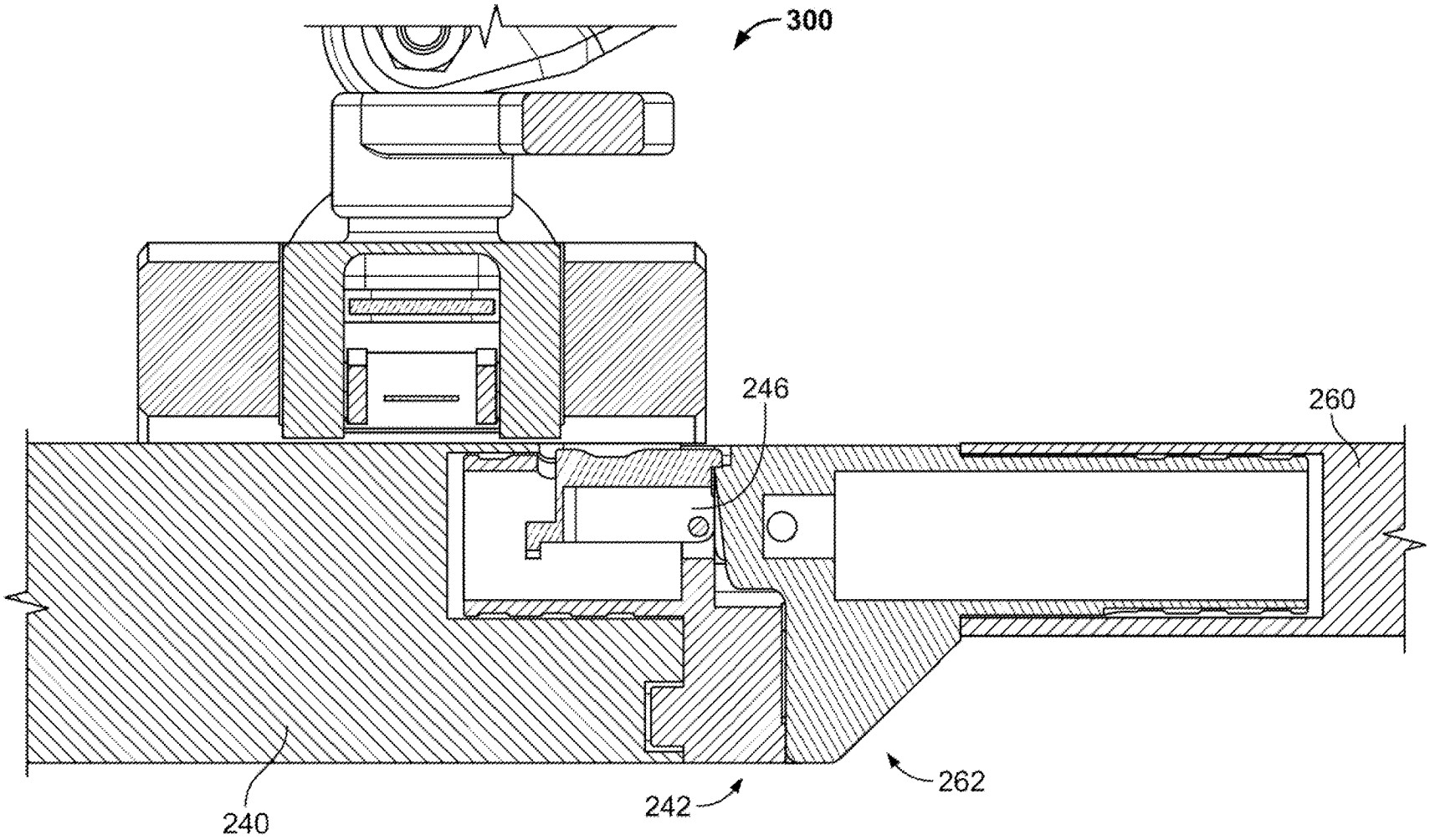
FIG. 3J is a cross-sectional view of the sled assembly coupled to the base bar and extension bar taken along line 3J-3J of FIG. 3E.

Once sled assembly 300 is on base bar 240, a user may attach, if desired, extension bar 260 to base bar 240, substantially as described above. As illustrated in FIG. 3J, once base bar 240 and extension bar 260 are coupled, coupling latch 246 is in a position substantially flush with the flattened top surface of base bar 240 and extension bar 260. This provides the ability for sled 300 to slide from base bar 240 to extension bar 260 without interruption from coupling latch 246. It should further be noted that the end of extension bar 240 opposite the second connecting portion 262 may include a stop to ensure sled assembly 300 does not unintentionally slide off the end of extension bar 260. This may be provided in the form of a pin, button, or other end stop structure extending generally upwards from the flattened top of extension bar 260 near an end portion. Other structures may be provided as well. For example, a coupling latch substantially identical to coupling latch 246 may be provided at the end of extension bar 260 to allow sled assembly 300 to slide over the end of extension bar in a first direction onto the extension bar 260, but not in a second direction off of the extension bar 260.

Figure 4A:
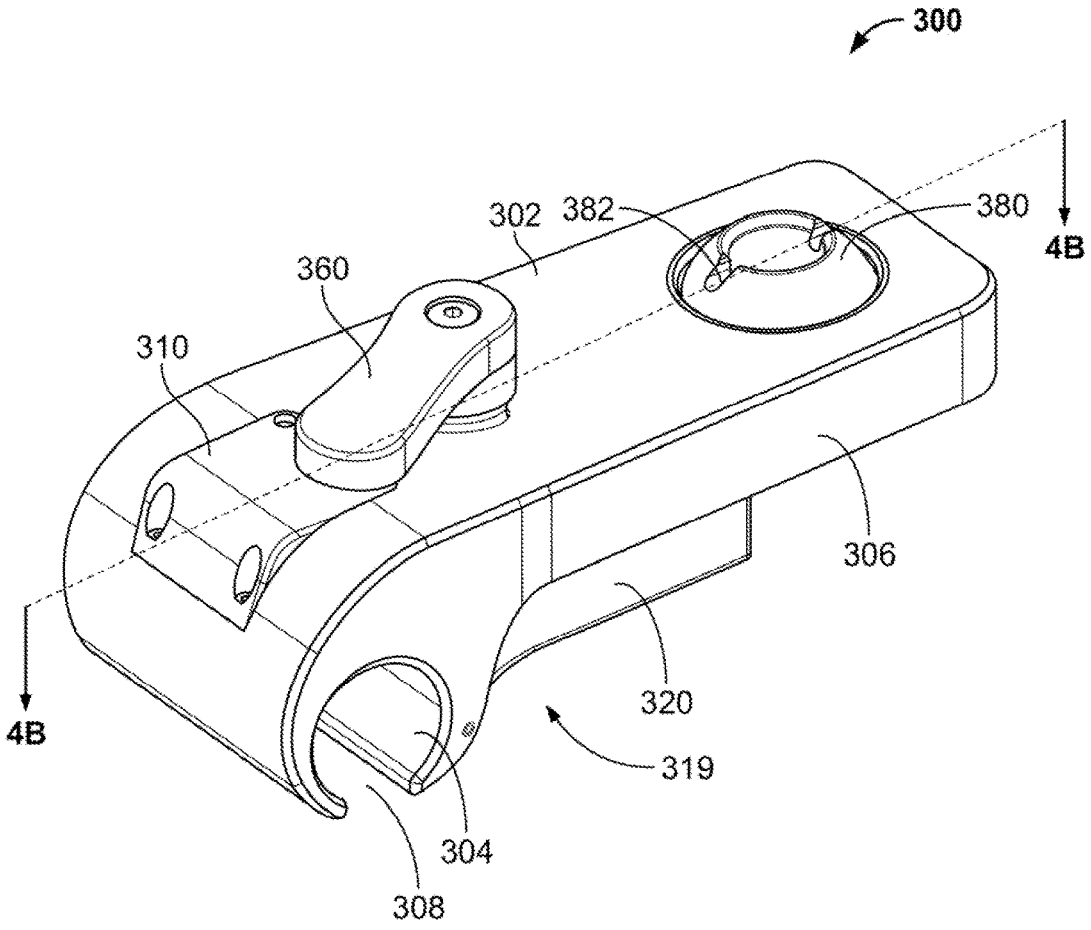
FIG. 4A is a perspective view of the sled assembly of FIG. 1.
Figure 4B:
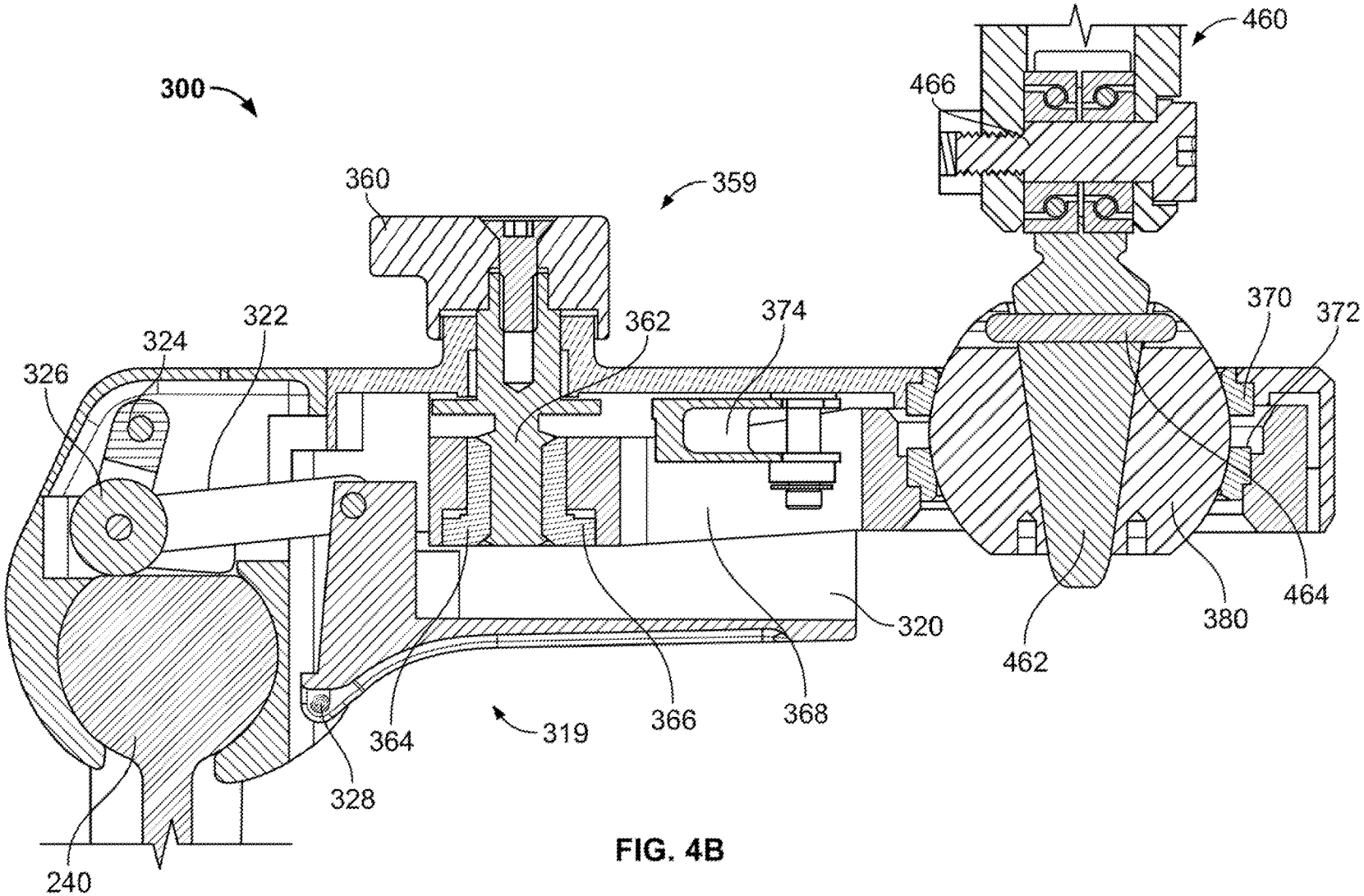
FIG. 4B is a cross-sectional view of the sled assembly of FIG. 4A taken along line 4B-4B coupled to the pylon and bar assembly and a limb holding assembly.
Figure 4C:
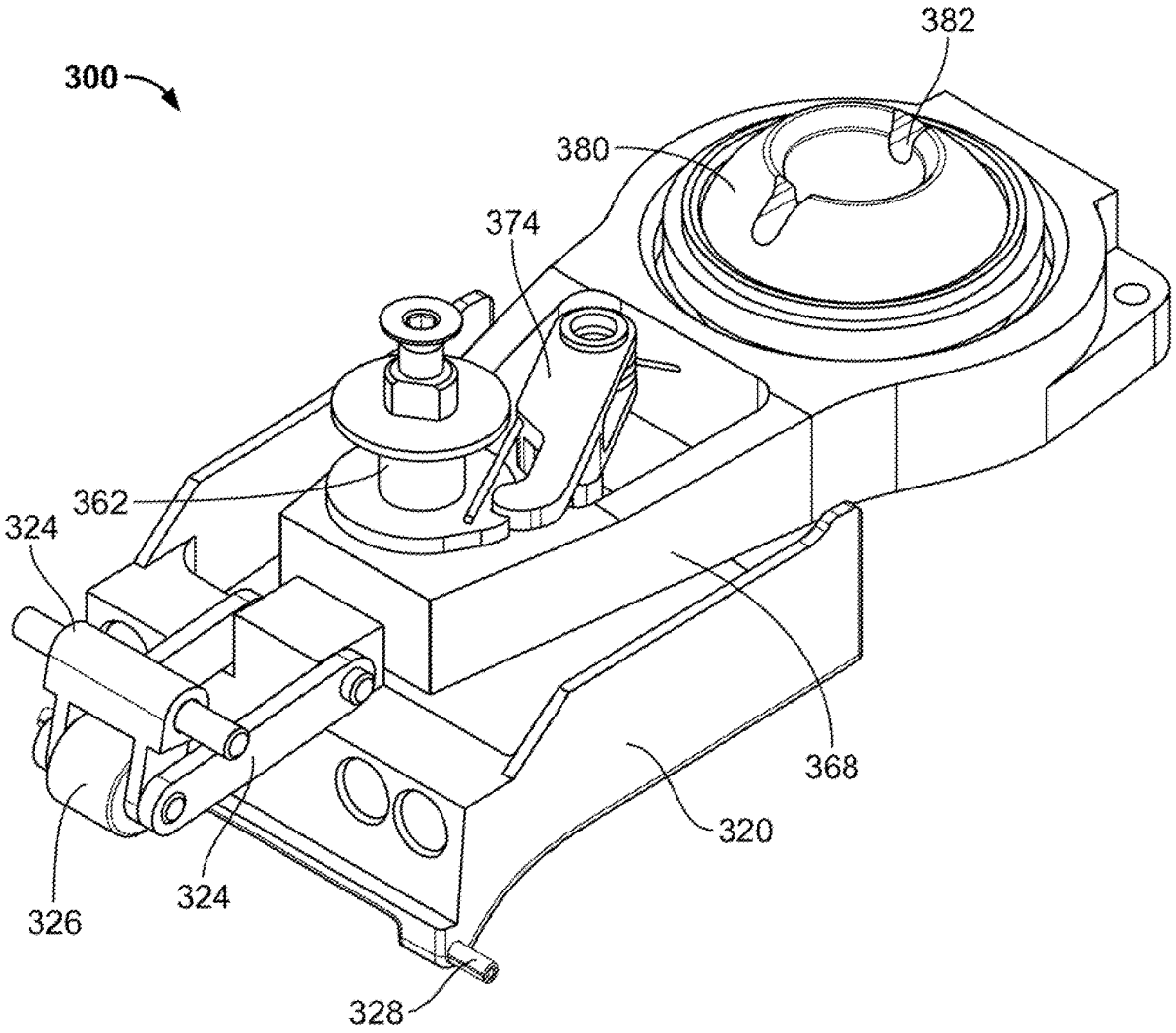
FIG. 4C is a perspective view of the sled assembly of FIG. 4A with certain components omitted.

Sled assembly 300 is illustrated in FIGS. 4A-C. Sled assembly 300 generally includes a sled body 302, a bar lock assembly 319, a ball 380, and a ball clamp assembly 359. Sled assembly 300 functions to slide along base bar 240 (and extension bar 260 if attached) and to support limb holding assembly 400 through a range of motion, as described below.

Sled body 302 generally includes a bar track 304 and a body extension 306. Bar track 304 may have generally circular or cylindrical ends trough which base bar 240 may extend. A bottom portion of bar track 304 may include a slot 308 extending the length of bar track 304 so as to not interfere with flange 244 of base bar 240 or flange 264 of bar extension 260.

The bar lock assembly of sled assembly 300 is best illustrated in FIG. 4B, which shows sled assembly 300 coupled to base bar 240. The bar lock assembly functions to lock or unlock the ability of sled assembly 300 from sliding along base bar 240. The bar lock assembly generally includes bar lock lever 320, connectors 322, link 324, and lock roller 326. Bar lock lever 320 may be connected to sled body 302 via a pin 328 about which bar lock lever 320 may pivot. As bar lock lever 320 pivots, connector 322 and link 324 move lock roller 326 laterally along the top flattened surface of base bar 240. Sled body 302 may include a relief portion 310 (FIG. 4A) to provide clearance for this motion. In a first position, lock roller 326 places little to no force on base bar 240, such that sled assembly 300 may freely slide along base bar 240. As lock roller 326 moves laterally toward the center of base bar 240, lock roller 326 places significant pressure on base bar 240, such that sled assembly 300 is fixed with respect to base bar 240. Preferably, bar lock lever 320 is biased, for example via a spring, such that sled assembly 300 is locked or fixed with respect to base bar 240 when there is no user intervention. If the user desires to unlock sled assembly 300 and slide sled assembly 300, he pulls on bar lock lever 320, compressing the spring and moving roller lock 326 out of engagement with the top flattened surface of base bar 240. Although other configurations may accomplish this motion, a circular or cylindrical roller lock 326 may be preferred as it does not result in skidding across base bar 240 and lowers wedging friction. This may reduce the rate at which these components degrade over time through normal use.

As noted above, sled assembly 300 may include ball 380 to which limb holding assembly 400 couples. Ball 380 provides for polyaxial motion of limb holding assembly 400. This connection and movement is described in greater detail below in connection to FIG. 5C. The extent to which ball 380 may move within sled assembly 300 may be controlled by the ball clamp assembly. The ball clamp assembly generally includes ball clamp lever 360 (omitted in FIG. 4C), ball clamp screw 362, ball clamp nut 364, spring washer 366, and ball clamp 368. Ball clamp 368 is coupled at a first end to ball clamp lever 360 via ball clamp screw 362, ball clamp nut 364, and spring washer 366. At a second end, ball clamp 368 is coupled to ball 380 via a pair of ball locks 370 and 372. Ball lock 370 may be generally annular, surrounding a portion of ball 380, and stationary relative to sled body 302. Ball lock 372 may be substantially identical to ball lock 370, and moveable toward or away to ball lock 370 to increase or decrease friction on ball 380.

In a locked position, in which ball 380 is locked from rotation, ball locks 370 and 372 are relatively close together. To move ball 380 into an unlocked position, a user may rotate ball clamp lever 360. As ball clamp lever 360 rotates, ball clamp screw 362 begins to unthread from ball clamp nut 364. As ball clamp screw 362 translates with respect to ball clamp nut 364, ball clamp 368 moves generally along with ball clamp nut 364. Movements of ball clamp 368 causes similar movement of ball lock 372 away from ball lock 370, reducing friction between ball locks 370, 372 and ball 380. Spring washer 366 may be positioned between ball clamp nut 364 and ball clamp 368 to maintain a light pressure on ball clamp 368, such that ball 380 may move with respect to ball locks 370 and 372, but to a limited degree. As illustrated in FIG. 4C, which illustrates certain internal components of sled assembly 300 (but omits others), ball clamp screw 362 may include one or more flanges. One of the flanges may include an extension that interacts with detent lever 374. Ball detent lever 374 may be biased, for example with a spring, to rotate toward ball clamp screw 362, such that ball clamp screw 362 may rotate a fixed amount prior to contacting detent lever 374, which prevents further rotation.

As noted above, ball clamp lever 360 may be rotated to loosen ball 380 to an unlocked position in which ball 380 may have measured polyaxial movement. It may be desirable to be further able to loosen ball 380, for example for sterilization of sled assembly 300 between uses. To better expose ball 380 for purposes of sterilization, ball lock 372 may be moved even further away from ball lock 370. In order to accomplish this, a user accesses detent lever 372, for example with a finger, and rotates it out of contact with the extension on the flange of ball clamp screw 362. With detent lever 372 clear of ball clamp screw 362, the user may rotate ball clamp lever 360 further and release detent lever 372. Ball clamp lever 360 may be rotated one full turn until the extension on the flange of ball clamp screw 362 again contacts detent lever 374, which moved to its original position when the user released his grip on it. With the above configuration, ball 380 remains within sled assembly 300 at all times, with at least three different possible states, including the locked state, a first unlocked state for measured movement of ball 380 within sled body 302, and a second unlocked state for sterilization.

Figure 5A:
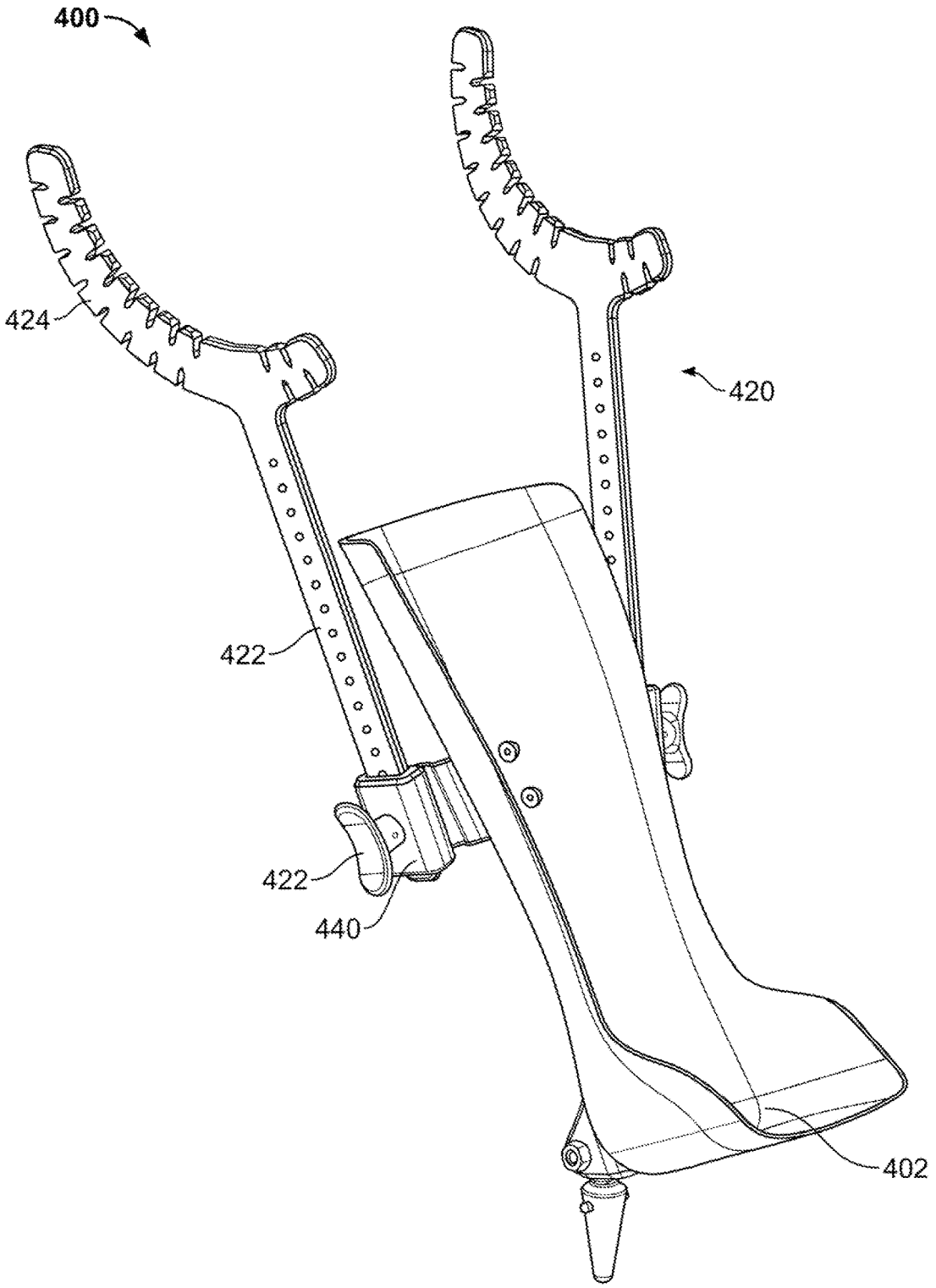
FIG. 5A is a front perspective view of the limb holding assembly of FIG. 1.
Figure 5B:
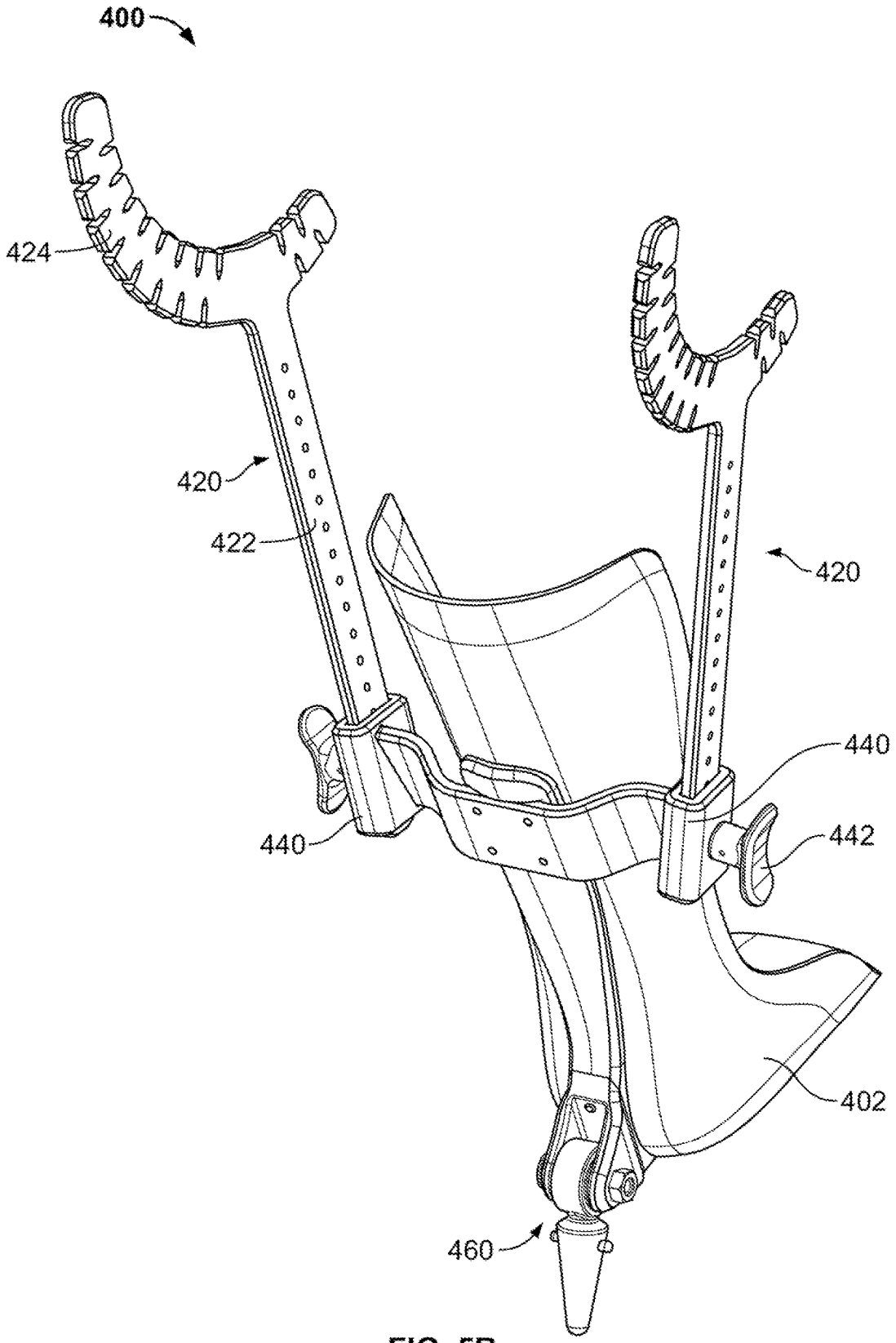
FIG. 5B is a rear perspective view of the limb holding assembly of FIG. 5A.

Limb holding assembly 400, which may be connected to sled assembly 300 as described below, is illustrated in FIGS. 5A-B. While limb holding assembly 400 may take various forms depending on the limb for which it will be used, limb holding assembly 400 generally takes the form of a boot 402 for positioning the heel of a foot and holding the foot and lower leg of a patient for a knee operation. Preferably, boot 402 is formed of a lightweight, strong, and compressible material so that a user may easily manipulate boot 402 while a foot is positioned therein. Boot 402 may be specifically shaped to match a particular patient, or may be shaped to have a high likelihood of being appropriately sized to fit a large portion of the population. For example, boot 402 may be designed based on anthropomorphic data such that it is sized to fit the 5th percentile female to the 95th percentile male.

During a typical surgical procedure, a patient's foot may freely sit within boot 402, or may be secured into boot 402, for example by straps or wrapping wrapped around the foot in boot 402, such as wrapping available under the trade name Coban. The straps or wrapping may be designed specifically for use with limb positioning system 10. Such straps and wrapping are described in more complete detail in U.S. Patent Publication No. 2013/0019883, the disclosure of which is hereby incorporated by reference herein.

Limb holding assembly 400 may include one or more accessory attachment features, such as wings or antlers 420. Each antler may have a first generally straight portion 422 coupled to a height adjuster 440. In the illustrated embodiment, each height adjuster 440 extends generally laterally in opposite directions from the rear of boot 402. The straight portion 422 may include a plurality of apertures along the length thereof. Each height adjuster 440 may include a knob 442 connected to a pin configured to extend through the apertures in straight portion 422, such that antlers 420 can be fixed at different heights with respect to boot 402. The height to which antlers 420 are able to extend via height adjuster 440 may have maximum or minimum presets. The value of the preset travel distance may be designed for a particular patient, or may be shaped to have a high likelihood of being appropriately sized to fit a large portion of the population. For example, the adjustable travel height may be designed based on anthropomorphic data such that it is sized to fit the 5th percentile female to the 95th percentile male.

The top end of the straight portions 422 of antlers 420 may be coupled to a curved portion 424. Each curved portion may include a plurality of attachment sites, such as apertures or notches. Curved portion 424 may be positioned in relation to straight portion 422 such that notches are positioned on each side of straight portion 422. The notches of curved portion 424 may be used to attach accessories to limb holding assembly 400. For example, retractors may be connected to curved portions 424 of antlers 420 such that, during a surgical procedure, retractors holding open the surgical site are connected to limb holding assembly 400. The notches may facilitate the retractors being held in place with tubing of various durometer or product specific strappage. Such retractors may have at least a portion thereof that is bioabsorbable as described, for example, in U.S. patent application Ser. No. 14/190,716, the disclosure of which is hereby incorporated by reference herein. In this configuration, as limb holding assembly 400 is positioned, moved, or repositioned with respect to the surgical table, the retractors may not need to be repositioned as they move along with limb holding assembly 400. This self-retaining quality of the retractors may allow for wound exposure with hands-free retraction, allowing the user to use both hands for performing a desired procedure. Other accessories instead of or in addition to retractors may be connected to antlers 420. For example, position tracking devices may be coupled to antlers 420 to track the position of the limb holding assembly 400 during a procedure.

Figure 5C:
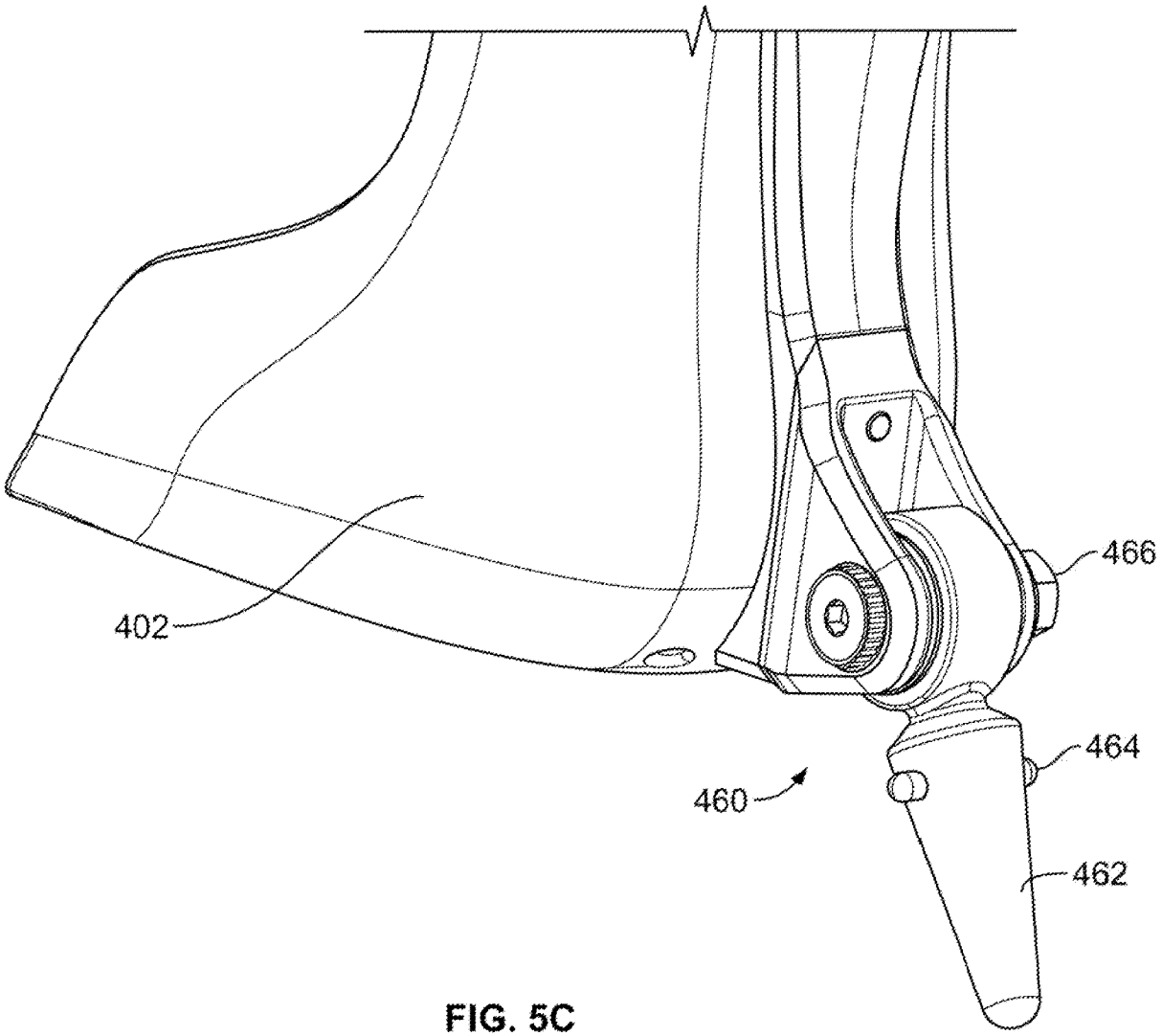
FIG. 5C is an enlarged perspective view of a connector portion of the limb holding assembly of FIG. 5A.
Figure 6:
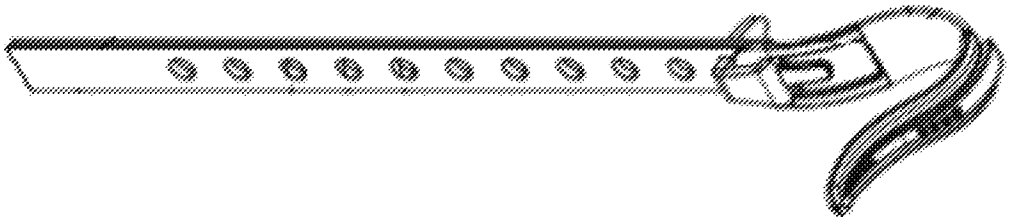
FIG. 6 shows an example of a retractor.
Figure 7:
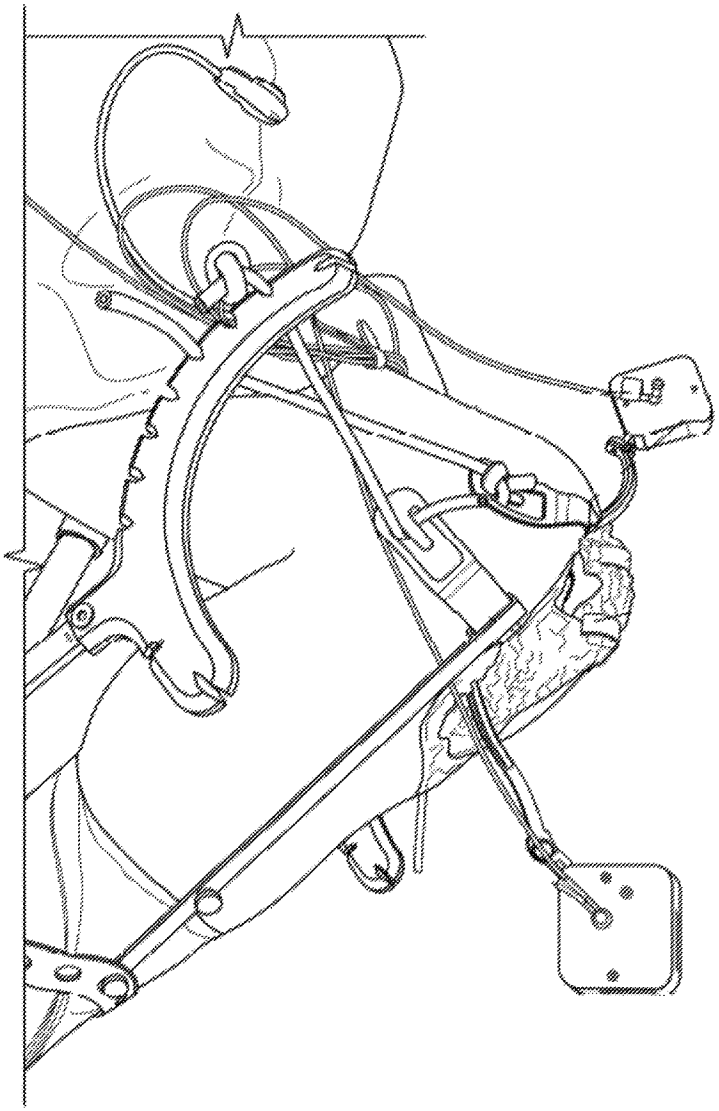
FIG. 7 shows an example of a retractor coupled to a device.
Figure 8:
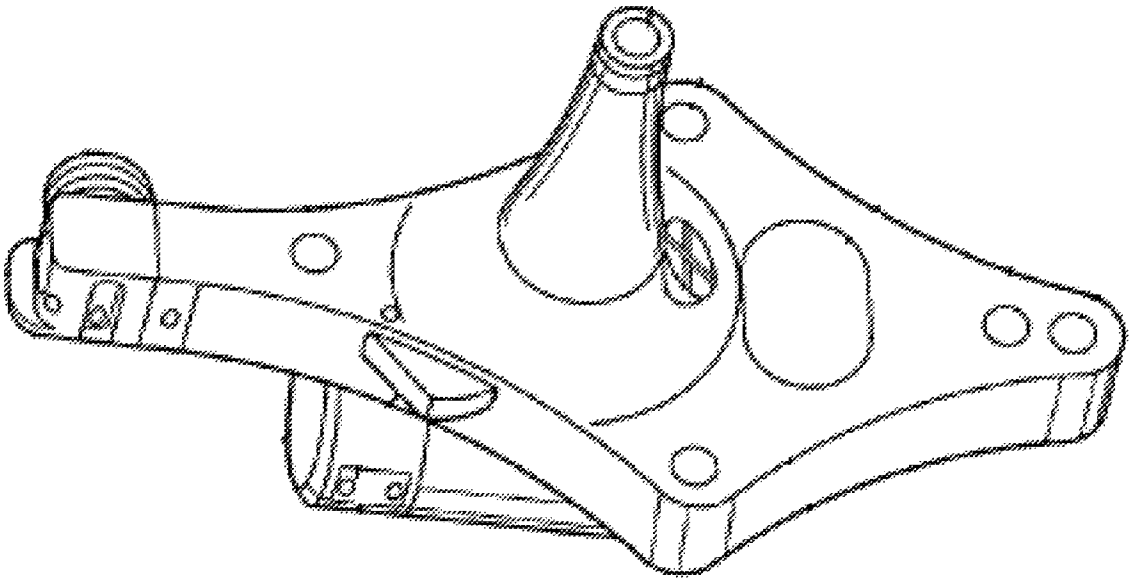
FIG. 8 shows an example of a tracking system.

Limb holding assembly 400 may include a connector portion 460. Connector portion 460 is best shown in FIGS. 4B and 5B-5C. Connector portion 460 may include a tapered portion 462 rotatably connected to a heel portion of boot 402. In the illustrated embodiment, tapered portion 462 is rotatable about a single axis with respect to boot 402. The rotation may be lockable, for example by a screw 466. Alternately, there may be enough friction between connector portion 460 and boot 402 such that connector portion 460 does not freely rotate, but rather rotates upon an application of a threshold force. Tapered portion 462 may include a pin 464 extending therethrough. Tapered portion 462 is configured to be inserted through a correspondingly tapered aperture within ball 380, with pin 464 sitting with grooves 382 of ball 380 (see FIGS. 4A-4C). In this configuration, tapered portion 462 cannot rotate with respect to ball 380. Further, boot 402 may be lifted out of ball 380 without needing to unlock any components. Preferably, tapered portion 462 of connector portion 460 is angled such that the taper is self-releasing, allowing relatively easy insertion and withdrawal of connector portion 460 into and out of ball 380.

Based on at least the above description, a number of benefits of limb positioning system 10 should be apparent. For example, a user may easily attach clamping assembly 100 to a variety of shapes of rails connected to an operating table. The connection allows for quick insertion of pylon and bar assembly 200 into clamping assembly 100 to fix base bar 240 at a desired height. The user may then easily slide sled assembly 300 onto base bar 240, or onto bar extension 260 if it has been attached to base bar 240. Limb holding assembly 400 can be quickly connected to sled assembly 300 without any additional locking steps being needed. Once a patient's foot is positioned within boot 402, the user may easily slide sled assembly 300 along the length of base bar 240 and bar extension 260 during the procedure by pressing on bar lock lever 320 and moving sled assembly 300 in the desired direction. Limb holding assembly 400 may be put through polyaxial rotation with respect to sled assembly 300, as desired by the user. Once in a desired position, the limb holding assembly 400 may be locked by a single turn of ball clamp lever 360. Boot 402 may also rotate about a single axis with respect to ball 380 to increase the range of positions of the patient's leg and knee.

Notably, the lower leg (or other limb) may be firmly held in place by limb holding assembly 400 in neutral, intermediate, and extreme positions. For example, during a knee surgery, the lower leg may be held at extreme internal or external rotation angles, which may be useful to open joint compartments at any desired level of flexion or extension. In addition, the self-releasing taper interface of connector portion 460 of limb holding assembly 400 and the complementary recess in ball 380 may allow the user to evaluate the patient's kinematic envelope and pathologic state as would normally be done in a clinical setting.

Through all of the above-described movement, retractors may be attached to antlers 420, holding the incision site open, without requiring the retractors to be removed and replaced prior to and after each repositioning of the knee. Further, tracking devices may be attached to antlers 420. The trackers may provide the ability to determine a position of the system 10 and/or the patient's limb held therein. Furthermore, trackers may be attached to a robot that controls the positioning of the components sled assembly 300 and limb holding assembly 400, such that some or all of the positioning may be automated.

As described above, limb positioning system 10 may be used with different parts of the body. When used with a foot and lower leg, an illustrative list of procedures which may be performed includes total knee arthroplasty, partial knee arthroplasty, patella-femoral resurfacing, anterior cruciate ligament ("ACL") reconstruction, high tibial osteotomy, tibial tubercle transfer, antegrade femoral nail, and focal plug defect management/osteochondral autograft transfer system ("OATS"). A variety of hip procedures, such as direct anterior hip replacement may also be performed using limb positioning system 10 with a foot and lower leg. It should be noted that minor mechanical modifications may be made to system 10 for use in other surgical procedures.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A limb positioning system comprising:

a clamp attachable to a patient support, the clamp having first and second channels;

a first support member including first and second pylons extending outwardly from an elongate rod, the first and second pylons being receivable in the first and second channels so that the first support member is slideable relative to the clamp along a first longitudinal axis;

a second support member coupled to the first support member so that the second support member is slideable relative to the first support member along a second longitudinal axis transverse to the first longitudinal axis; and a limb holder coupled to the second support member, wherein the clamp includes a first wheel adjacent the first channel, and a second wheel adjacent the second channel, the first pylon includes a plurality of first notches spaced apart from one another, each first notch configured to receive the first wheel, and the second pylon includes a plurality of second notches spaced apart from one another, each second notch configured to receive the second wheel.

2. The limb positioning system of claim 1, wherein the limb holder is polyaxially and hingedly coupled to the second support member.

3. The limb positioning system of claim 1, further comprising a mount polyaxially coupled to the second support member, wherein the limb holder is hingedly coupled to the mount.

4. The limb positioning system of claim 3, wherein the limb holder is detachably coupled to the mount.

5. The limb holder positioning system of claim 1, further comprising:

a height adjustment member coupled to a rear of the limb holder; and a support wing adjustably coupled to the height adjustment member.

* * * * *